US008512923B2

(12) United States Patent
Hosoi et al.

(10) Patent No.: US 8,512,923 B2
(45) Date of Patent: Aug. 20, 2013

(54) ELECTROPHOTOGRAPHIC PHOTOSENSITIVE MEMBER AND ELECTROPHOTOGRAPHIC APPARATUS

(75) Inventors: Kazuto Hosoi, Mishima (JP); Jun Ohira, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 103 days.

(21) Appl. No.: 13/147,468

(22) PCT Filed: Apr. 15, 2010

(86) PCT No.: PCT/JP2010/057106

§ 371 (c)(1),
(2), (4) Date: Aug. 2, 2011

(87) PCT Pub. No.: WO2010/123045

PCT Pub. Date: Oct. 28, 2010

(65) Prior Publication Data

US 2011/0299886 A1 Dec. 8, 2011

(30) Foreign Application Priority Data

Apr. 20, 2009 (JP) ..... 2009-101836
May 12, 2009 (JP) ..... 2009-116021
Apr. 7, 2010 (JP) ..... 2010-088797

(51) Int. Cl.
*G03G 5/085* (2006.01)

(52) U.S. Cl.
USPC ..... 430/65; 430/57.4; 430/58.1; 430/64; 430/66

(58) Field of Classification Search
USPC ..... 430/57.4, 58.1, 64, 65, 66
See application file for complete search history.

(56) References Cited

U.S. PATENT DOCUMENTS 6,753,123 B2 6/2004 Okamura et al.
6,846,600 B2 1/2005 Ehara et al.
6,991,879 B2 1/2006 Hosoi et al.

(Continued)

FOREIGN PATENT DOCUMENTS

CN 101276162 A 10/2008
EP 1158368 A2 11/2001

(Continued)

OTHER PUBLICATIONS

Notification of Transmittal of the International Search Report and the Written Opinion of the International Searching Authority dated Jun. 1, 2010, International Search Report, and Written Opinion in related corresponding PCT International Application No. PCT/JP2010/057106.

(Continued)

*Primary Examiner* — Peter Vajda
(74) *Attorney, Agent, or Firm* — Fitzpatrick, Cella, Harper & Scinto

(57) ABSTRACT

An electrophotographic photosensitive member is disclosed which has a change layer consisting of five or more a-SiC intermediate layers, provided between an a-Si photoconductive layer and an a-SiC surface layer. Where two layers contiguous to each other in which C/(Si+C) is from 0.35 to 0.65 are selected from among the a-SiC intermediate layers included in the change layer, the rate of increase between the C/(Si+C) of an a-SiC intermediate layer on the photoconductive layer side and the C/(Si+C) of an a-SiC intermediate layer on the surface layer side (i.e., the rate of increase between layers) is 19% or less.

9 Claims, 4 Drawing Sheets

(56) References Cited

U.S. PATENT DOCUMENTS

| | | | | |
|---|---|---|---|---|
| 7,033,717 | B2 | 4/2006 | Kojima et al. | |
| 7,033,721 | B2 | 4/2006 | Hashizume et al. | |
| 7,157,197 | B2 | 1/2007 | Aoki et al. | |
| 7,211,357 | B2 | 5/2007 | Hosoi et al. | |
| 7,255,969 | B2 | 8/2007 | Kojima et al. | |
| 7,381,510 | B2 | 6/2008 | Akiyama et al. | |
| 7,498,110 | B2 | 3/2009 | Taniguchi et al. | |
| 7,678,518 | B2 | 3/2010 | Yagi et al. | |
| 7,932,005 | B2 | 4/2011 | Ohira et al. | |
| 2005/0026057 | A1 * | 2/2005 | Hosoi et al. | 430/56 |
| 2005/0208399 | A1 | 9/2005 | Akiyama et al. | |
| 2005/0238976 | A1 | 10/2005 | Taniguchi et al. | |
| 2006/0160004 | A1 | 7/2006 | Aoki et al. | |
| 2008/0070138 | A1 | 3/2008 | Yagi et al. | |

FOREIGN PATENT DOCUMENTS

| | | | |
|---|---|---|---|
| EP | 1 505 445 | A1 | 2/2005 |
| EP | 1158368 | A2 | 11/2011 |
| JP | 61-159657 | A | 7/1986 |
| JP | 09-244284 | A | 9/1997 |
| JP | 2005-301233 | A | 10/2005 |
| JP | 2005-301253 | A | 10/2005 |
| JP | 2006-189823 | A | 7/2006 |

OTHER PUBLICATIONS

Chinese Office Action dated Jan. 17, 2013, in related Chinese Patent Application No. 2010800172422 (with English translation).

European Search Report dated Jun. 13, 2013, in related European Patent Application No. 10767102.6.

* cited by examiner

ELECTROPHOTOGRAPHIC PHOTOSENSITIVE MEMBER AND ELECTROPHOTOGRAPHIC APPARATUS

TECHNICAL FIELD

This invention relates to an electrophotographic photosensitive member and an electrophotographic apparatus.

BACKGROUND ART

As a type of electrophotographic photosensitive members used in electrophotographic apparatus, an electrophotographic photosensitive member is widely known which has a photoconductive layer (photosensitive layer) made up of amorphous silicon and a surface layer provided on the photoconductive layer and made up of hydrogenated amorphous silicon carbide. The photoconductive layer made up of amorphous silicon and the surface layer made up of hydrogenated amorphous silicon carbide are formed by, e.g., a film forming technique such as plasma CVD. Hereinafter, the amorphous silicon is also termed as "a-Si", the photoconductive layer made up of a-Si is also termed as "a-Si photoconductive layer", and the electrophotographic photosensitive member having such an a-Si photoconductive layer is also termed as "a-Si photographic photosensitive member". The hydrogenated amorphous silicon carbide is also termed as "a-SiC", and the surface layer made up of a-SiC is also termed as "a-SiC surface layer".

Regarding such an a-Si photographic photosensitive member, it has been studied to provide between the a-Si photoconductive layer and the a-SiC surface layer an intermediate layer made up of a-SiC (Japanese Patent Applications Laid-open No. 2005-301233 and No. S61-159657). Such an intermediate layer is provided for various purposes of, e.g., preventing interference of the light that reflects from the surface of the surface layer with the light that reflects at an interface between the surface layer and the photoconductive layer, and improving delamination resistance (adherence) between the photoconductive layer and the surface layer. In some cases, it is provided not only as a single layer but also as a plurality of intermediate layers. An intermediate layer made up of a-SiC is hereinafter also termed as "a-SiC intermediate layer".

In spite of such an a-Si photographic photosensitive member having been so far studied and improved as above, in the present state of affairs, there still remains room for further improvement from the viewpoint of making electrophotographic process higher in speed and higher in image quality in recent years.

For example, as the electrophotographic process is made higher in speed, the electrophotographic apparatus becomes higher in process speed, where, e.g., a cleaning blade may chatter to tend to cause slip-through of a toner (developer). As a countermeasure therefor, a method is available in which the cleaning blade is pressed against the electrophotographic photosensitive member at a higher pressure.

However, studies made by the present inventors have revealed that, where a plurality of a-SiC intermediate layers are provided between the a-Si photoconductive layer and the a-SiC surface layer, the a-SiC intermediate layers more tend to come to separate between their layers with an increase in the pressure at which the cleaning blade is pressed against the electrophotographic photosensitive member. This is because such an increase in the pressure at which the cleaning blade is pressed against the electrophotographic photosensitive member makes stress concentrate at an interface(s) between layers of the a-SiC intermediate layers provided in plurality between the a-Si photoconductive layer and the a-SiC surface layer, as so considered.

DISCLOSURE OF THE INVENTION

An object of the present invention is to provide an electrophotographic photosensitive member the a-SiC intermediate layers of which can not easily come to separate between their layers (i.e., to cause delamination) even in the case when a plurality of a-SiC intermediate layers are provided between the a-Si photoconductive layer and the a-SiC surface layer, and provide an electrophotographic apparatus having such an electrophotographic photosensitive member.

The present invention is an electrophotographic photosensitive member having a substrate, a photoconductive layer provided on the substrate and constituted of amorphous silicon, and provided on the photoconductive layer a surface layer constituted of hydrogenated amorphous silicon carbide, wherein;

the electrophotographic photosensitive member further has, between the photoconductive layer and the surface layer, a change layer consisting essentially of five or more intermediate layers each constituted of hydrogenated amorphous silicon carbide, where;

the ratio of the number of atoms of carbon atoms (C) to the sum of the number of atoms of silicon atoms (Si) and number of atoms of carbon atoms (C), C/(Si+C), in each of the intermediate layers included in the change layer increases monotonously from the innermost intermediate layer on the side of the photoconductive layer toward the outermost intermediate layer on the side of the surface layer;

in the change layer, two or more intermediate layers are included in which the ratio of the number of atoms of carbon atoms (C) to the sum of the number of atoms of silicon atoms (Si) and number of atoms of carbon atoms (C), C/(Si+C), is in the range of from 0.35 or more to 0.65 or less;

where, among the intermediate layers included in the change layer, two layers contiguous to each other are selected from among intermediate layers in which the ratio of the number of atoms of carbon atoms (C) to the sum of the number of atoms of silicon atoms (Si) and number of atoms of carbon atoms (C), C/(Si+C), is in the range of from 0.35 or more to 0.65 or less, and, between the two layers contiguous to each other, the ratio of the number of atoms of carbon atoms (C) to the sum of the number of atoms of silicon atoms (Si) and number of atoms of carbon atoms (C), C/(Si+C), in an intermediate layer on the side of the photoconductive layer is represented by A, and the ratio of the number of atoms of carbon atoms (C) to the sum of the number of atoms of silicon atoms (Si) and number of atoms of carbon atoms (C), C/(Si+C), in an intermediate layer on the side of the surface layer is represented by B, all the intermediate layers in which the ratio of the number of atoms of carbon atoms (C) to the sum of the number of atoms of silicon atoms (Si) and number of atoms of carbon atoms (C), C/(Si+C), is in the range of from 0.35 or more to 0.65 or less satisfy, among the layers, that the rate of increase between layers as defined by the following expression (1):

$$\text{Rate of increase between layers}=\{(B-A)/A\}\times 100(\%) \quad (1)$$

is 19% or less;

the ratio of the number of atoms of carbon atoms (C) to the sum of the number of atoms of silicon atoms (Si) and number of atoms of carbon atoms (C), C/(Si+C), in the surface layer is from 0.61 or more to 0.90 or less; and the ratio of the number of atoms of carbon atoms (C) to the sum of the number of atoms of silicon atoms (Si) and number of atoms of carbon atoms (C), C/(Si+C), in the surface layer is larger than the ratio of the number of atoms of carbon atoms (C) to the sum of the number of atoms of silicon atoms (Si) and number of atoms of carbon atoms (C), C/(Si+C), in any intermediate layer included in the change layer.

According to the present invention, it can provide an electrophotographic photosensitive member the a-SiC intermediate layers of which can not easily come to separate between their layers even in the case when a plurality of a-SiC intermediate layers are provided between the a-Si photoconductive layer and the a-SiC surface layer, and can provide an electrophotographic apparatus having such an electrophotographic photosensitive member.

Further features of the present invention will become apparent from the following description of exemplary embodiments with reference to the attached drawings.

BEST MODE FOR CARRYING OUT THE INVENTION

The electrophotographic photosensitive member of the present invention is, as mentioned above, an electrophotographic photosensitive member having a substrate, a photoconductive layer provided on the substrate and made up of amorphous silicon (a-Si), and provided on the photoconductive layer a surface layer made up of hydrogenated amorphous silicon carbide (a-SiC). Then, the electrophotographic photosensitive member of the present invention further has, between the photoconductive layer and the surface layer, a change layer consisting essentially of five or more intermediate layers each made up of hydrogenated amorphous silicon carbide.

Examples of layer configuration of the electrophotographic photosensitive member of the present invention are shown in FIGS. 1A to 1D.

Figure 1A:
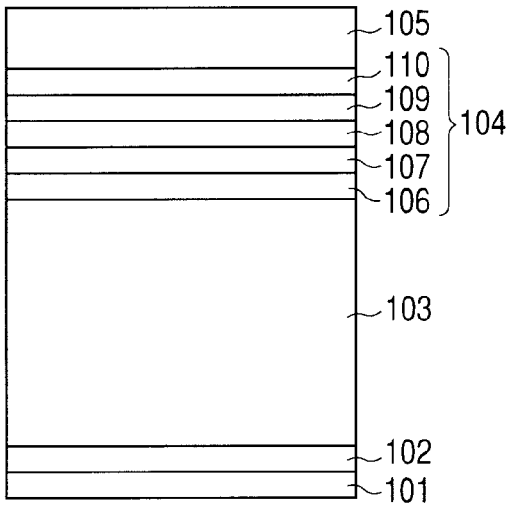
FIGS. 1A, 1B, 1C and 1D are views showing examples of layer configuration of the electrophotographic photosensitive member of the present invention.

In the electrophotographic photosensitive member having layer configuration shown in FIG. 1A, it has a substrate 101 and formed thereon, and in the order of, a lower-part charge injection blocking layer 102, a photoconductive layer 103, a change layer 104 consisting of five intermediate layers (a first intermediate layer 106 to a fifth intermediate layer 110), and a surface layer 105. The photoconductive layer 103 is made up of a-Si. The respective intermediate layers included in the change layer 104, and the surface layer 105, are each made up of a-SiC.

Figure 1B:
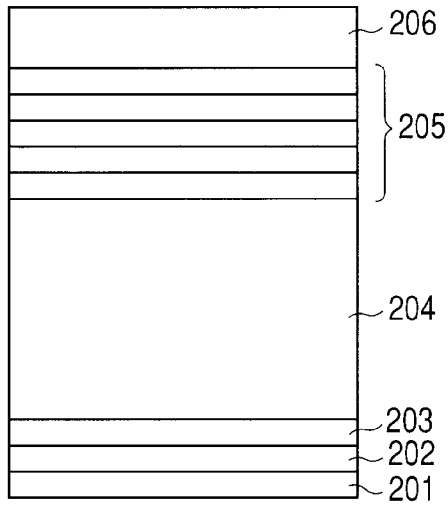

In the electrophotographic photosensitive member having layer configuration shown in FIG. 1B, it has a substrate 201 and formed thereon, and in the order of, lower-part charge injection blocking layers 202 and 203, a photoconductive layer 204, a change layer 205 consisting of five intermediate layers, and a surface layer 206. The photoconductive layer 204 is made up of a-Si. The respective intermediate layers included in the change layer 205, and the surface layer 206, are each made up of a-SiC.

Figure 1C:
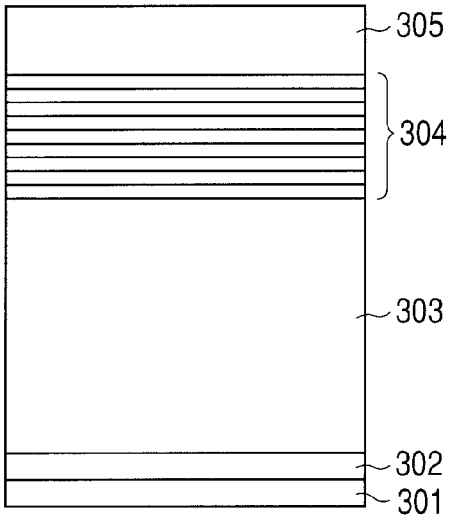

In the electrophotographic photosensitive member having layer configuration shown in FIG. 1C, it has a substrate 301 and formed thereon, and in the order of, a lower-part charge injection blocking layer 302, a photoconductive layer 303, a change layer 304 consisting of nine intermediate layers, and a surface layer 305. The photoconductive layer 303 is made up of a-Si. The respective intermediate layers included in the change layer 304, and the surface layer 305, are each made up of a-SiC.

Figure 1D:
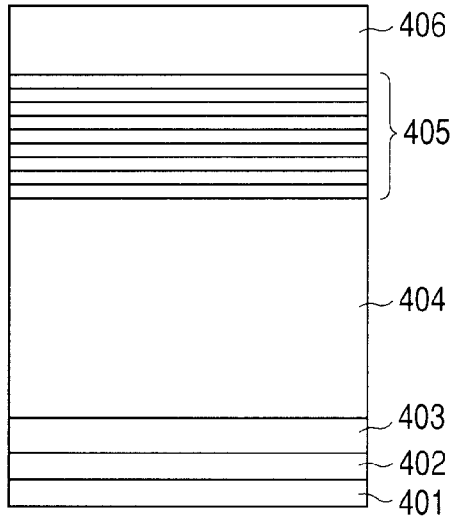

In the electrophotographic photosensitive member having layer configuration shown in FIG. 1D, it has a substrate 401 and formed thereon, and in the order of, lower-part charge injection blocking layers 402 and 403, a photoconductive layer 404, a change layer 405 consisting of nine intermediate layers, and a surface layer 406. The photoconductive layer 404 is made up of a-Si. The respective intermediate layers included in the change layer 405, and the surface layer 406, are each made up of a-SiC.

The respective layers and substrate are described below in detail.

Change Layer and Intermediate Layers Included in Change Layer:

The "change layer" of the electrophotographic photosensitive member of the present invention means a layer consisting of five or more a-SiC intermediate layers (a layer of laminated structure in which five or more a-SiC intermediate layers are set in layers).

Then, the ratio of the number of atoms of carbon atoms (C) to the sum of the number of atoms of silicon atoms (Si) and number of atoms of carbon atoms (C), C/(Si+C), in each of the a-SiC intermediate layers included in the change layer of the electrophotographic photosensitive member of the present invention increases monotonously from the innermost intermediate layer on the photoconductive layer side toward the outermost intermediate layer on the surface layer side. The ratio of the number of atoms of carbon atoms (C) to the sum of the number of atoms of silicon atoms (Si) and number of atoms of carbon atoms (C), C/(Si+C), is hereinafter simply called as "C/(Si+C)".

Thus, the change layer in which the C/(Si+C) becomes gradually larger from the photoconductive layer side toward the surface layer side is provided between the a-Si photoconductive layer and the a-SiC surface layer. This enables improvement in delamination resistance between the a-Si photoconductive layer, the C/(Si+C) of which is infinitely close to 0 (zero), and the a-SiC surface layer, the C/(Si+C) of which is 0.61 or more.

Further, in the change layer of the electrophotographic photosensitive member of the present invention, two or more intermediate layers are included in which the C/(Si+C) is in the range of from 0.35 or more to 0.65 or less. Then, where two layers contiguous to each other are selected from among intermediate layers in which the C/(Si+C) is in the range of from 0.35 or more to 0.65 or less, and, between the two layers contiguous to each other, the C/(Si+C) in an intermediate layer on the photoconductive layer side is represented by A and the C/(Si+C) in an intermediate layer on the surface layer side is represented by B, all the intermediate layers in which the C/(Si+C) is in the range of from 0.35 or more to 0.65 or less satisfy, among the layers, that the rate of increase between layers as defined by the following expression (1):

$$\text{Rate of increase between layers}=\{(B-A)/A\}\times 100(\%) \quad (1)$$

is 19% or less.

In virtue of employment of the change layer thus made up, the a-SiC intermediate layers can not easily come to separate between their layers even in the case when the change layer consisting of five or more a-SiC intermediate layers is provided between the a-Si photoconductive layer and the a-SiC surface layer.

(Measurement and Calculation of C/(Si+C) of Each Layer and Layer Thickness:)

In the present invention, the C/(Si+C) is measured and calculated by using a cross-section transmission electron microscope (cross-section TEM). First, an electrophotographic photosensitive member to be measured is cut out in a size of 1 cm×1 cm, and this is placed on a focused ion beam system (FIB, manufactured by Hitachi Ltd.; trade name: FB-2000C) to make micro-sampling. This cross section is observed on a field emission electron microscope (high-resolution transmission electron microscope HR-TEM, manufactured by JOEL Ltd.; trade name: JEM-2100F), and the C/(Si+C) is calculated by characteristic X-ray diffraction, using an energy dispersive X-ray microanalyzer (EDX, manufactured by JOEL Ltd.; trade name: JED-2300T). As conditions for measurement, accelerating voltage is set at 200 kV, EDX spot analysis time is 30 to 40 seconds, and beam diameter is 1 nm.

Stated more specifically, from the above cross section, a bright-field image (BF-STEM image) and a high-angle annular dark-field image (HAADF-STEM image) are photographed on a scanning TEM (STEM). The BF-STEM image relatively more reflects difference-in-height contrasts at interfaces; and the HAADF-STEM image, contrasts due to differences in composition of the respective layers. Hence, these are combined to determine the layer thickness of each layer.

Next, the EDX spot analysis is made on the basis of images obtained by STEM. From the values of analysis thus obtained, the number of atoms of silicon atoms (Si) and the number of atoms of carbon atoms (C) are found to calculate the C/(Si+C).

The change layer of the electrophotographic photosensitive member of the present invention is described below in greater detail by giving an example.

For example, in the electrophotographic photosensitive member having layer configuration shown in FIG. 1A, regarding the C/(Si+C) of each of the first intermediate layer 106 to fifth intermediate layer 110 that are included in the change layer 104, that of the first intermediate layer 106 is set to be 0.05; the second intermediate layer 107, 0.16; the third intermediate layer 108, 0.39; the fourth intermediate layer 109, 0.46; and the fifth intermediate layer 110, 0.54.

In the above example, the third intermediate layer 108, the fourth intermediate layer 109 and the fifth intermediate layer 110 correspond to the a-SiC intermediate layers in which the C/(Si+C) is in the range of from 0.35 or more to 0.65 or less. Also, regarding the rate of increase between layers as defined by the expression (1), it comes between the third intermediate layer 108 and the fourth intermediate layer 109 that {(0.46−0.39)/0.39}×100=18%. Between the fourth intermediate layer 109 and the fifth intermediate layer 110, it comes that {(0.54−0.46)/0.46}×100=17%. That is, in the case of the above example, the rate of increase is 19% or less both between the third intermediate layer 108 and the fourth intermediate layer 109 and between the fourth intermediate layer 109 and the fifth intermediate layer 110, and hence these a-SiC intermediate layers have been made not to easily come to separate between their layers.

Meanwhile, the rate of increase is 220% between the first intermediate layer 106 and the second intermediate layer 107 and the rate of increase is 144% between the second intermediate layer 107 and the third intermediate layer 108, thus the rate of increase in either of these is more than 19%. However, it has been ascertained by experiments made by the present inventors that, even if the rate of increase is more than 19%, the delamination resistance between layers of the a-SiC intermediate layers is not so much influenced when the C/(Si+C) of at least one a-SiC intermediate layer of the two layers contiguous to each other is not in the range of from 0.35 or more to 0.65 or less.

In the present invention, the number of layers of the a-SiC intermediate layers included in the change layer may enough be at least five layers, from the viewpoint of improving the delamination resistance between the a-Si photoconductive layer and the a-SiC surface layer. Meanwhile, from the viewpoint of keeping the electrophotographic photosensitive member from lowering in sensitivity (photosensitivity), the number of layers of the a-SiC intermediate layers included in the change layer may preferably be nine layers or less.

The a-SiC intermediate layers included in the change layer may each preferably have a layer thickness of from 10 nm or more to 200 nm or less, from the viewpoint of improving the delamination resistance or keeping non-uniform sensitivity from coming from any instable production (layer formation). Where a layer having a small layer thickness is formed, commonly the time for forming the layer must be set short. Here, if the time for forming the layer is set too short, it may be difficult to stably control conditions for layer formation (e.g., in CVD, parameters such as reactor inner pressure and high-frequency power). If the conditions for layer formation can not stably be controlled, the layer formed tends to stand greatly non-uniform in layer thickness and film quality. Then, such non-uniform layer thickness and film quality of the layer tend to cause non-uniform sensitivity. If on the other hand the layer is in too large thickness, a low delamination resistance may result. This is considered due to the fact that the layer increases in stress with an increase in layer thickness.

Among the a-SiC intermediate layers included in the change layer, any a-SiC intermediate layers in which the C/(Si+C) is 0.35 or less may preferably have a layer thickness of 200 nm or less in total, from the viewpoint of keeping the electrophotographic photosensitive member from lowering in sensitivity. This is due to the fact that such a-SiC intermediate layers in which the C/(Si+C) is 0.35 or less are layers relatively easily absorptive of the imagewise exposure light that is used in usual electrophotographic apparatus. If the a-SiC intermediate layers relatively easily absorptive of such imagewise exposure light has a large layer thickness, it comes about that the change layer unwantedly absorbs much of imagewise exposure light which should originally reach the photoconductive layer, and hence the electrophotographic photosensitive member tends to have a low sensitivity.

The a-SiC intermediate layers included in the change layer may also preferably be incorporated with halogen atoms in addition to silicon atoms, carbon atoms and hydrogen atoms, in order to compensate unbonded arms in the a-SiC.

In such a-SiC intermediate layers, the ratio of the sum of the number of atoms of hydrogen atoms (H) and number of atoms of halogen atoms (X) to the sum of the number of atoms of silicon atoms (Si), number of atoms of hydrogen atoms (H) and number of atoms of halogen atoms (X), (H+X)/(Si+H+X), may preferably be from 0.05 or more, and much preferably 0.10 or more. It may also preferably be 0.70 or less, and much preferably 0.50 or less.

At least one a-SiC intermediate layer incorporated with Group 13 element (which refers to Group 13 element of the periodic table; the same applies hereinafter) may also be included in the change layer, whereby any negative electric charges can be prevented from being injected into the photoconductive layer when the surface of the electrophotographic photosensitive member is negatively electrostatically charged. Thus, this can make the electrophotographic photosensitive member usable as a negative-charging electrophotographic photosensitive member.

In the case when at least one a-SiC intermediate layer incorporated with Group 13 element is included in the change layer, the C/(Si+C) in the a-SiC intermediate layer(s) incorporated with Group 13 element may preferably be 0.10 or more from the viewpoint of keeping blurred images from occurring.

For example, in the above example, the second intermediate layer 107 and the third intermediate layer 108 are further taken as a-SiC intermediate layers incorporated with Group 13 element.

In such a case, the second intermediate layer 107 to the fifth intermediate layer 110 corresponds to a-SiC intermediate layers in which the C/(Si+C) is 0.10 or more, and, in such layers, the second intermediate layer 107 and the third intermediate layer 108 are also included which are the a-SiC intermediate layers incorporated with Group 13 element.

On the other hand, any a-SiC intermediate layer in which the C/(Si+C) is less than 0.10 may preferably be not incorporated with Group 13 element from the viewpoint of keeping blurred images from occurring. In the above example, the first intermediate layer 106 corresponds thereto. This is concerned with whether or not holes can easily move in that layer. That is, such an a-SiC intermediate layer in which the C/(Si+C) is less than 0.10 has a relatively high dark conductivity by nature, and hence it is a layer in which the holes can relatively easily move. If the a-SiC intermediate layer having such properties is carelessly further incorporated with Group 13 element, which makes the holes easily move, it may inevitably be a layer through which the holes can very easily move. Where electrostatic latent images are formed on the surface of the negative-charging electrophotographic photosensitive member, the holes in an a-SiC intermediate layer that are generated upon exposure to imagewise exposure light may so act as to move toward the a-SiC surface layer in order to cancel negative electric charges present on the surface of the negative-charging electrophotographic photosensitive member. When the holes move in this way, it comes that they pass through the change layer. However, if such a layer through which the holes can very easily move is included in the change layer, the holes, moving differently from their original movement, may unwantedly move also in the direction parallel to the surface of the electrophotographic photosensitive member. As the result, the electrostatic latent images formed may inevitably stand blurred, resulting in blurred images, as so considered.

The Group 13 element that may be incorporated in the a-SiC intermediate layer(s) may specifically include a boron (B) atom, an aluminum (Al) atom, a gallium (Ga) atom, an indium (In) atom and a thallium (Tl) atom. Of these, a boron (B) atom is preferred.

Where the a-SiC intermediate layers are formed by CVD, a source material for feeding boron atoms may include, e.g., $BCl_3$, $BF_3$, $BBr_3$ and $B_2H_6$. Of these, $B_2H_6$ is preferred in view of readiness in handling.

The Group 13 element in the a-SiC intermediate layer(s) may preferably be in a content of from 100 atom ppm or more to 3,000 atom ppm or less, based on the total number of elements constituting all the a-SiC intermediate layers.

The a-SiC intermediate layer(s) incorporated with Group 13 element may preferably have a layer thickness of 50 nm or more in total, from the viewpoint of charging performance, in particular, the ability to block the injection of negative electric charges into the photoconductive layer under conditions of a high electric field. This is because such blocking ability under conditions of a high electric field may lower if the a-SiC intermediate layer(s) incorporated with Group 13 element, having the ability to block the injection of negative electric charges into the photoconductive layer, has or have too small layer thickness.

The a-SiC intermediate layer(s) incorporated with Group 13 element may also preferably have a layer thickness of 1,000 nm or less in total, from the viewpoint of keeping blurred images from occurring. This is concerned with whether or not the holes can move in the layer(s) with ease, i.e., the distance of movement of the holes. More specifically, the a-SiC intermediate layer(s) incorporated with Group 13 element is/are layer(s) in which the holes can relatively easily move, compared with any layer having the same C/(Si+C) and not incorporated with Group 13 element. Where electrostatic latent images are formed on the surface of the negative-charging electrophotographic photosensitive member, the holes in an a-SiC intermediate layer(s) that are generated upon exposure to imagewise exposure light may so act as to move toward the a-SiC surface layer in order to cancel negative electric charges present on the surface of the negative-charging electrophotographic photosensitive member. When the holes move in this way, it comes that they pass through the change layer. However, if such a layer(s) through which the holes can easily move is/are present in the change layer in a layer thickness larger than the stated one, the holes may unwantedly move, among distances of their movement, in a large distance in the in-plane direction parallel to the surface of the electrophotographic photosensitive member which distance differs from that of their original movement. If the distance of movement in this in-plane direction exceeds a certain level, the electrostatic latent images formed may inevitably stand blurred, resulting in blurred images, as so considered.

Where two or more a-SiC intermediate layers incorporated with Group 13 element are included in the change layer, it is preferable that the amount of Group 13 element incorporated in such layers stands larger with an increase in the C/(Si+C) of the a-SiC intermediate layers incorporated with Group 13 element, from the viewpoint of charging performance, in particular, the ability to block the injection of negative electric charges into the photoconductive layer under conditions of a high electric field. This is considered due to the fact that the amount of Group 13 element preferable from the viewpoint of charging performance, in particular, the ability to block the injection of negative electric charges into the photoconductive layer under conditions of a high electric field becomes larger with an increase in the C/(Si+C).

The Group 13 element incorporated in the a-SiC intermediate layers may evenly uniformly be distributed in the a-SiC intermediate layers, or may be distributed in such a state that they are distributed non-uniformly in the layer thickness direction of the a-SiC intermediate layers. In either case, however, in the in-plane direction parallel to the surface of the electrophotographic photosensitive member, the Group 13 element may evenly be contained in a uniform distribution in the a-SiC intermediate layers. This is preferable from the viewpoint of the achievement of uniform properties in the in-plane direction.

Incidentally, in the present invention, in the "a-SiC intermediate layer(s) incorporated with Group 13 element", a case is not embraced in which the Group 13 element comes unintentionally incorporated in the a-SiC intermediate layer(s), i.e., a case in which the Group 13 element stands incorporated therein at what is called a level of contamination. The level of contamination herein referred to is 1 atom ppm or less, based on the total number of elements constituting the a-SiC intermediate layers.

The a-SiC intermediate layers may be formed by any method including, e.g., a plasma CVD process, a vacuum deposition process, a sputtering process and an ion plating process. Of these, the plasma CVD process is preferred in view of, e.g., readiness in feeding source materials.

How to form the a-SiC intermediate layers is as described below when the plasma CVD process is employed as a method for forming the layers.

Basically, a source gas for feeding silicon atoms and a source gas for feeding carbon atoms are each introduced in the desired gaseous state into a reactor the interior of which can be evacuated, and then glow discharge may be caused to take place in the reactor to thereby decompose the source gases introduced thereinto, and thus the a-SiC intermediate layers may be formed on a substrate kept placed at a stated position (i.e., on what comprises the substrate on which the a-Si photoconductive layer has been formed).

As the source gas for feeding silicon atoms, it may include, e.g., silanes such as silane ($SiH_4$) and disilane ($Si_2H_6$). Also, the source gas for feeding carbon atoms, it may include, e.g., hydrocarbons such as methane ($CH_4$) and acetylene ($C_2H_2$).

The temperature of the substrate may preferably be set at a temperature of from 200° C. or more to 450° C. or less, and much preferably from 250° C. or more to 350° C. or less. This is to accelerate the reaction to effect structural relaxation sufficiently.

The internal pressure of the reactor may preferably be set at from $1\times10^{-2}$ Pa or more to $1\times10^{3}$ Pa or less, much preferably from $5\times10^{-2}$ Pa or more to $5\times10^{2}$ Pa or less, and still much preferably from $1\times10^{-1}$ Pa or more to $1\times10^{2}$ Pa or less.

Discharge frequency used in plasma CVD may be an RF band frequency of from 1 MHz or more to 30 MHz or less.

Film-forming parameters such as source gas flow rates, reactor inner pressure and high-frequency power may appropriately be changed to control the C/(Si+C) in the a-SiC intermediate layers to be formed.

Surface Layer:

The a-SiC surface layer is formed on the change layer described above.

How to form the a-SiC surface layer, source gases, substrate temperature, reactor inner pressure, high-frequency power used in plasma CVD, and so forth may be the same as those in the case of the a-SiC intermediate layers described above.

In the present invention, the C/(Si+C) in the a-SiC surface layer is from 0.61 or more to 0.90 or less. Forming such a surface layer enables the electrophotographic photosensitive member to be improved in its wear resistance and scratch resistance. In particular, this C/(Si+C) may preferably be 0.70 or more from the viewpoint of improvement in the wear resistance and scratch resistance. That this C/(Si+C) is on the other hand 0.90 or less is preferable from the viewpoint of keeping the a-SiC surface layer itself from having a low hardness.

The a-SiC surface layer may also preferably be incorporated with halogen atoms in addition to silicon atoms, carbon atoms and hydrogen atoms, in order to compensate unbonded arms in the a-SiC.

The ratio of the sum of the number of atoms of hydrogen atoms (H) and number of atoms of halogen atoms (X) to the sum of the number of atoms of silicon atoms (Si), number of atoms of hydrogen atoms (H) and number of atoms of halogen atoms (X), (H+X)/(Si+H+X), in the a-SiC surface layer may preferably be from 0.05 or more, and much preferably 0.10 or more. It may also preferably be 0.70 or less, and much preferably 0.50 or less.

The a-SiC surface layer may preferably have a layer thickness of 100 nm or more from the viewpoint of the wear resistance and scratch resistance of the electrophotographic photosensitive member.

Photoconductive Layer:

The a-Si photoconductive layer is formed between the substrate or lower-part charge injection blocking layer, detailed later, and the change layer described above.

How to form the a-Si photoconductive layer, source gases, substrate temperature, reactor inner pressure, high-frequency power used in plasma CVD, and so forth may be the same as those in the case of the a-SiC intermediate layers described above, except for what concerns the carbon atoms.

The a-Si photoconductive layer may also preferably be incorporated with hydrogen atoms and/or halogen atoms in addition to silicon atoms, in order to compensate unbonded arms in the a-Si.

The ratio of the sum of the number of atoms of hydrogen atoms (H) and number of atoms of halogen atoms (X) to the sum of the number of atoms of silicon atoms (Si), number of atoms of hydrogen atoms (H) and number of atoms of halogen atoms (X), (H+X)/(Si+H+X), in the a-Si photoconductive layer may preferably be from 0.10 or more, and much preferably 0.15 or more. It may also preferably be 0.30 or less, and much preferably 0.25 or less.

The a-Si photoconductive layer may also optionally be incorporated with atoms for controlling conductivity.

The atoms for controlling conductivity that are incorporated in the a-Si photoconductive layer may evenly uniformly be distributed in the a-Si photoconductive layer, or may be distributed in such a state that they are distributed non-uniformly in the layer thickness direction of the a-Si photoconductive layer. In either case, however, in the in-plane direction parallel to the surface of the electrophotographic photosensitive member, the atoms for controlling conductivity may evenly be contained in a uniform distribution in the a-Si photoconductive layer. This is preferable from the viewpoint of the achievement of uniform properties in the in-plane direction.

The atoms for controlling conductivity that may be incorporated in the a-Si photoconductive layer may include what is called impurities, used in the field of semiconductors. That is, usable are Group 13 elements, which provide the a-Si photoconductive layer with p-type conductivity, and Group 15 elements, which provide the a-Si photoconductive layer with n-type conductivity.

The Group 13 elements may include a boron (B) atom, an aluminum (Al) atom, a gallium (Ga) atom, an indium (In) atom and a thallium (Tl) atom. Of these, a boron (B) atom, an aluminum (Al) atom and a gallium (Ga) atom are particularly preferred.

The Group 15 elements may include a phosphorus (P) atom, an arsenic (As) atom, an antimony (Sb) atom and a bismuth (Bi) atom. Of these, a phosphorus (P) atom and an arsenic (As) atom are particularly preferred.

The atoms for controlling conductivity in the a-Si photoconductive layer may preferably be in a content of from $1\times10^{-2}$ atom ppm or more to $1\times10^{4}$ atom ppm or less, much preferably from $5\times10^{-2}$ atom ppm or more to $5\times10^{3}$ atom ppm or less, and still much preferably from $1\times10^{-1}$ atom ppm or more to $1\times10^{3}$ atom ppm or less, based on the total number of elements constituting the a-Si photoconductive layer.

The a-Si photoconductive layer may preferably have a layer thickness of 15 μm or more, and much preferably 20 μm or more, and may on the other hand preferably have a thickness of 60 μm or less, much preferably 50 μm or less, and still much preferably 40 μm or less. If the a-Si photoconductive layer has too small layer thickness, the rate of electric current passing through a charging member may increase to accelerate deterioration of the electrophotographic photosensitive member. If on the other hand the a-Si photoconductive layer has too large layer thickness, the size of a site grown abnormally in the a-Si making up the a-Si photoconductive layer may become large. Stated specifically, the site grown abnormally in the a-Si may come to be in a size of 50 to 150 μm in the horizontal direction and 5 to 20 μm in the height direction, and this may unnegligibly damage any members which rub the surface of the electrophotographic photosensitive member, or may cause image defects.

The a-Si photoconductive layer may be of single-layer structure made up of a single layer or may be of laminated structure separated into a charge generation layer and a charge transport layer.

Lower-Part Charge Injection Blocking Layer:

The electrophotographic photosensitive member of the present invention may preferably be, in order to improve its performance, provided with a lower-part charge injection blocking layer between the substrate and the a-Si photoconductive layer.

The lower-part charge injection blocking layer may preferably be a layer made up of a-Si or a-SiC.

How to form the lower-part charge injection blocking layer, source gases, substrate temperature, reactor inner pressure, high-frequency power used in plasma CVD, and so forth may be the same as those in the case of the a-SiC intermediate layers described previously.

The lower-part charge injection blocking layer may be incorporated with atoms for controlling conductivity, so as to control conductivity (p-type or n-type) of the lower-part charge injection blocking layer, and provide it with the ability to block the injection of electric charges into the photoconductive layer from the substrate. In this case, the lower-part charge injection blocking layer may optionally be incorporated with carbon atoms (C), nitrogen atoms (N) or oxygen atoms (O) so as to control any stress in the lower-part charge injection blocking layer to improve delamination resistance between the substrate and the photoconductive layer.

The types, state of distribution and content of atoms in the case when the lower-part charge injection blocking layer is incorporated with the atoms for controlling conductivity may be the same as those in the case when the a-Si photoconductive layer is incorporated with the atoms for controlling conductivity.

The lower-part charge injection blocking layer may also be provided in plurality so as to be of a laminated structure as shown in FIGS. 1B and 1D. In the case when the lower-part charge injection blocking layer is formed in laminated structure, it may be formed in double-layer structure in which a first lower-part charge injection blocking layer 202 or 402 and a second lower-part charge injection blocking layer 203 or 403 are set in layers in this order from the substrate 201 or 401 side. In the case of the negative-charging electrophotographic photosensitive member, the first lower-part charge injection blocking layer 202 or 402 may preferably be a layer made up of a-SiC incorporated with Group 13 element, and the second lower-part charge injection blocking layer 203 or 403 may preferably be a layer made up of a-SiC incorporated with Group 15 element. Forming the lower-part charge injection blocking layer in such a laminated structure enables high-level achievement of both characteristics such as dark attenuation and residual potential and prevention of insulation breakdown.

The lower-part charge injection blocking layer may preferably be incorporated with hydrogen atoms and/or halogen atoms in addition to silicon atoms (and carbon atoms), in order to compensate unbonded arms in the a-Si or a-SiC.

The ratio of the sum of the number of atoms of hydrogen atoms (H) and number of atoms of halogen atoms (X) to the sum of the number of atoms of silicon atoms (Si), number of atoms of hydrogen atoms (H) and number of atoms of halogen atoms (X), (H+X)/(Si+H+X), in the lower-part charge injection blocking layer may preferably be from 0.05 or more, and much preferably 0.10 or more. It may also preferably be 0.70 or less, and much preferably 0.50 or less.

Substrate:

The substrate 101 and so forth may make use of, e.g., a metal such as copper, aluminum, nickel, cobalt, iron, chromium or molybdenum or an ally of any of these. Of these, from the viewpoint of workability and production cost, aluminum or an aluminum alloy is preferred, and an aluminum-magnesium alloy and an aluminum-manganese alloy are much preferred.

How to Produce Electrophotographic Photosensitive Member:

Next, a case in which the electrophotographic photosensitive member of the present invention is produced by using plasma CVD is described with reference to the drawings.

Figure 3:
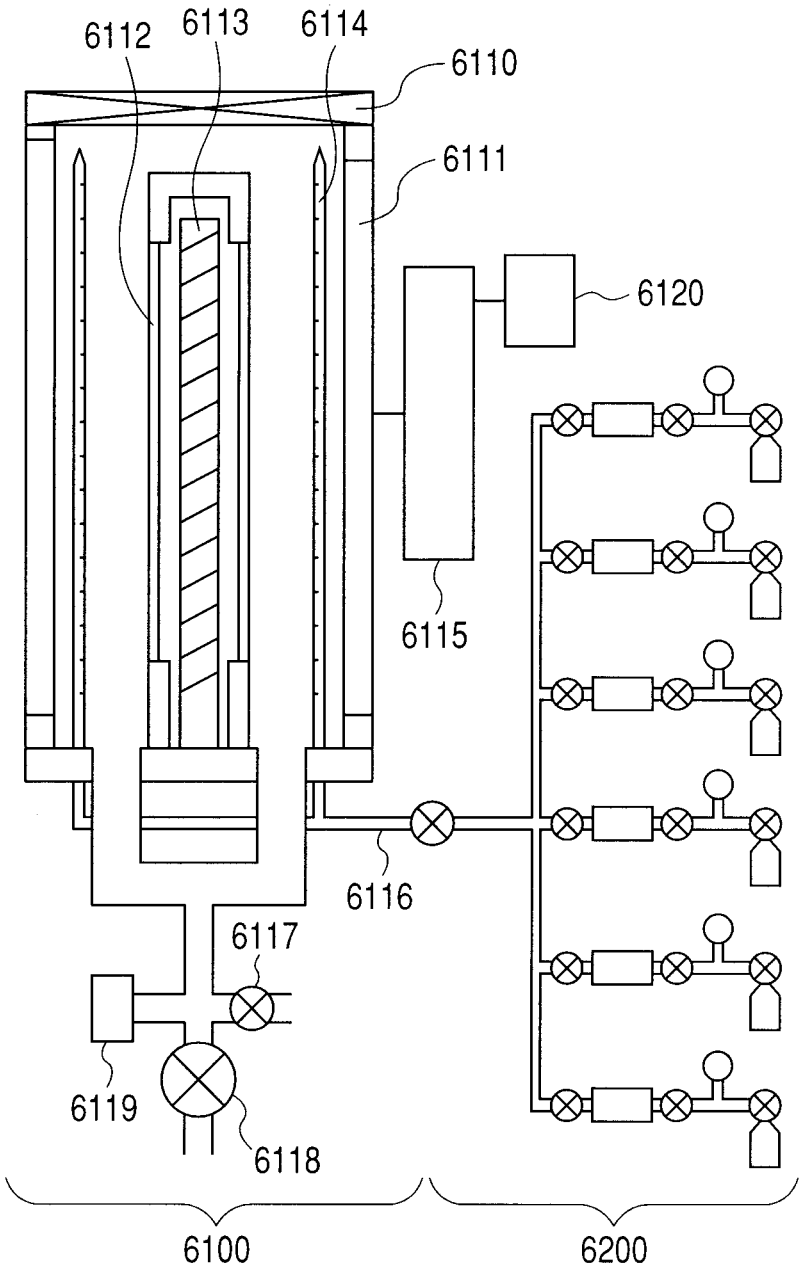
FIG. 3 is a view showing an example of a deposited-film forming apparatus which is of a plasma CVD system.

FIG. 3 shows an example of an apparatus (a film forming system) for forming deposited films by plasma CVD.

The deposited film forming apparatus shown in FIG. 3 is chiefly constituted of a deposition system 6100, a source gas feed system 6200 and an exhaust system (not shown) for evacuating the interior of a reactor 6110. The deposition system 6100 is provided with a cathode electrode 6111, and a high-frequency power source 6120 is connected to the cathode electrode 6111 through a high-frequency matching box 6115. The reactor 6110 is also provided therein with a heater 6113 for heating the substrate, and a source gas feed pipe 6114.

The reactor 6110 is connected to an exhaust system (not shown) through an exhaust valve 6118, and the interior of the reactor 6110 is set able to be evacuated.

The source gas feed system 6200 is constituted of gas cylinders for source gases, which are connected to the gas feed pipe 6114 in the reactor 6110.

Using the deposited film forming apparatus shown in FIG. 3, deposited films (layers such as the a-Si photoconductive layer, the a-SiC intermediate layers and the a-SiC surface layer are formed according to, e.g., the following procedure.

First, a substrate 6112 is set in the reactor 6110, and the interior of the reactor 6110 is evacuated by means of an exhaust device (not shown) such as a vacuum pump. Subsequently, the temperature of the substrate 6112 is controlled at a stated temperature in the range of, e.g., from 200° C. or more to 350° C. or less by means of the heater 6113 for heating the substrate.

Next, source gases for forming the deposited film are fed into the reactor 6110, controlling their flow rates by operating the source gas feed system 6200. Then, while watching the indication of a vacuum gauge 6119, an exhaust valve 6118 is operated to set the interior at a stated pressure.

After the formation of deposited films has been thus readied to start, each deposited film is formed according to the following procedure.

At the time the pressure in the reactor has become stable, the high-frequency power source 6120 is set at the desired electric power, and the electric power is supplied to the cathode through the high-frequency matching box 6115 to cause high-frequency glow discharge to take place. An RF band of 1 MHz to 30 MHz may preferably be used as the frequency used for the glow discharge.

The source gases fed into the reactor 6110 are decomposed by discharge energy thus produced by the high-frequency glow discharge, so that a stated deposited film is formed on the surface of the substrate 6112. After a deposited film with a desired layer thickness has been formed, the supply of high-frequency power is stopped, and the valves of the gas feed system are closed to stop source gases from flowing into the reactor 6110, thus the formation of the deposited film is completed.

The like operation is repeated plural times while changing conditions such as source gas flow rates, pressure and high-frequency power, whereby a electrophotographic photosensitive member with a desired multi-layer structure can be produced.

In order to make uniform the deposited films to be formed, it is also effective to rotate the substrate 6112 at a stated speed by means of a driving mechanism (not shown) while the deposited films are being formed.

After the formation of all deposited films has been completed, a leak valve 6117 is opened to return the internal pressure of the reactor 6111 to atmospheric pressure, where the substrate 6112 with deposited films is taken out.

Figure 2:
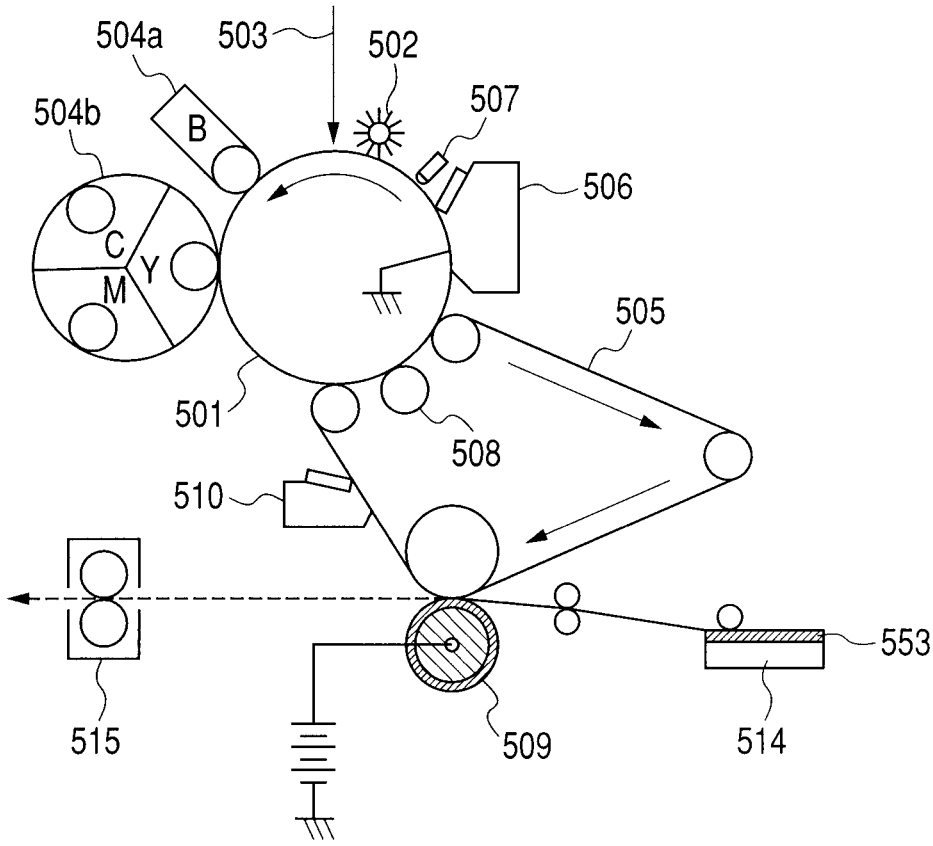
FIG. 2 is a view showing an example of the electrophotographic apparatus of the present invention.

Electrophotographic Apparatus:

An example of the electrophotographic apparatus of the present invention is shown in FIG. 2.

The electrophotographic apparatus shown in FIG. 2 has an electrophotographic photosensitive member 501 on the surface of which electrostatic latent images are to be formed, where a toner adheres to the electrostatic latent images to form toner images, and which member is repeatedly used. Around the electrophotographic photosensitive member 501, a charging assembly (a charging means) 502 is disposed with which the surface of the electrophotographic photosensitive member 501 is electrostatically charged to positive or negative polarity and potential. From the viewpoint of image quality, the charging assembly 502 may preferably be a contact charging means having magnetic particles which are provided in contact with the surface of the electrophotographic photosensitive member 501.

Around the electrophotographic photosensitive member 501, an imagewise exposure unit (not shown; an imagewise exposure means) is also disposed with which the surface of the electrophotographic photosensitive member 501 thus charged is exposed to imagewise exposure light 503 to form electrostatic latent images thereon.

As the imagewise exposure unit, used is, e.g., an optical system of color separation/image-forming exposure of color original images, or a scanning exposure system using a laser scanner which outputs laser beams having been modulated correspondingly to time-sequential electrical digital image signals of image information. From the viewpoint of image quality, it is preferable to form the electrostatic latent images on the surface of a negative-charging electrophotographic photosensitive member by the image area exposure method (IAE method) of exposing to light the areas corresponding to image areas.

Around the photosensitive member 501, a first developing assembly 504*a* having a black toner B is also disposed as a developing assembly (a developing means) which performs development by making a toner adhere thereto to form toner images. A rotary type second developing assembly 504*b* is still also disposed which is built-in provided with a two-component developing assembly having a yellow toner Y, a two-component developing assembly having a magenta toner M and a two-component developing assembly having a cyan toner C. From the viewpoint of image quality, the second developing assembly 504*b* may preferably be a two-component developing means having a toner and magnetic particles.

Around the electrophotographic photosensitive member 501, a cleaner (a cleaning means) 506 is also provided which is for cleaning the surface of the electrophotographic photosensitive member 501 after the toner images have been transferred therefrom to an intermediate transfer belt 505. What is meant by the "cleaning" is to remove toners (transfer residual toners) having remained on the surface of the electrophotographic photosensitive member 501 after the toner images have been transferred to the intermediate transfer belt 505.

Around the electrophotographic photosensitive member 501, a charge elimination exposure unit (a destaticization means) 507 is still also provide which destaticizes the surface of the electrophotographic photosensitive member 501.

The intermediate transfer belt 505 is so disposed as to be driven while forming a contact nip zone between it and the electrophotographic photosensitive member 501. The intermediate transfer belt 505 is provided on its inside with a primary transfer roller 508 for transferring to the intermediate transfer belt 505 the toner images formed on the surface of the electrophotographic photosensitive member 501. To the primary transfer roller 508, a bias power source (not shown) is connected which is for applying to the primary transfer roller 508 a primary transfer bias for transferring to the surface of the intermediate transfer belt 505 the toner images held on the surface of the electrophotographic photosensitive member 501.

Around the intermediate transfer belt 505, a secondary transfer roller 509 for secondarily transferring to a transfer material (a recording material) 553 the toner images transferred to the intermediate transfer belt 505 is so provided as to come into contact with the surface of the intermediate transfer belt 505. To the secondary transfer roller 509, a bias power source is connected which is for applying to the secondary transfer roller 509 a secondary transfer bias for transferring to the transfer material 553 the toner images held on the surface of the intermediate transfer belt 505. An intermediate transfer belt cleaner 510 is also provided which is for removing toners (secondary transfer residual toners) having remained on the surface (i.e., for cleaning the surface) of the intermediate transfer belt 505 after the toner images on the intermediate transfer belt 505 have been transferred to the transfer material 553.

In the case of an intermediate transfer system as in the above, the intermediate transfer belt 505, the primary transfer roller 508, the secondary transfer roller 509 and so forth fall under transfer means.

In the electrophotographic apparatus shown in FIG. 2, the apparatus is so set up that the toner images are primarily transferred to the surface of the intermediate transfer belt 505 and thereafter the toner images thus transferred are secondarily transferred to the transfer material 553 (i.e., the intermediate transfer system). The electrophotographic apparatus of the present invention, however, is not limited to the electrophotographic photosensitive member of such an intermediate transfer system. For example, the apparatus may also be so set up that the toner images are directly transferred from the surface of the electrophotographic photosensitive member 501 to the transfer material 553 without providing the intermediate transfer belt 505.

The electrophotographic apparatus shown in FIG. 2 is also provided with a paper feed cassette 514 which holds therein a plurality of transfer materials 553 on which images are to be formed. The electrophotographic apparatus shown in FIG. 2 is still also provided with a transport mechanism which is for transporting the transfer material 553 from the paper feed cassette 514 to a contact nip zone formed between the intermediate transfer belt 505 and the secondary transfer roller 509.

The electrophotographic apparatus shown in FIG. 2 is still also provided, on the transfer material 553 transport path, with a fixing assembly (a fixing means) 515 which fixes to the transfer material 553 the toner images having been transferred to the transfer material 553.

The present invention is described below in greater detail by giving Examples and Comparative Examples.

Example 1

Using as a substrate (a conductive substrate) a cylinder obtained by mirror-finishing the surface of a pipe section made of aluminum and being 84 mm in diameter, 381 mm in length and 3 mm in wall thickness, a positive-charging electrophotographic photosensitive member was produced by using the deposited-film forming apparatus shown in FIG. 3.

In this Example, a positive-charging electrophotographic photosensitive member having the layer configuration shown in FIG. 1A was produced.

Conditions for forming respective layers (film forming conditions) are shown in Table 1. In Table 1, the layer thickness of each layer shows a designed value for each layer.

TABLE 1

| Gases & gas flow rates: | Lower-part charge injection blocking layer | Photoconductive layer | Change layer Intermediate layers: 1st | 2nd | 3rd | 4th | 5th | Surface layer |
|---|---|---|---|---|---|---|---|---|
| $SiH_4$ [ml/min(normal)] | 80 | 85 | 75 | 55 | 20 | 17 | 12 | 15 |
| $H_2$ [ml/min(normal)] | 480 | 680 | — | — | — | — | — | — |
| $B_2H_6$ (ppm) (based on $SiH_4$) | 2,300 | 1 | — | — | — | — | — | — |
| NO (%) (based on $SiH_4$) | 5 | — | — | — | — | — | — | — |
| $CH_4$ [ml/min(normal)] | — | — | 25 | 45 | 120 | 150 | 200 | 450 |
| Substrate temp.: (° C.) | 270 | 260 | 240 | 240 | 240 | 240 | 240 | 240 |
| Reactor internal pressure: (Pa) | 80 | 80 | 50 | 50 | 50 | 50 | 50 | 60 |
| High-frequency power: (W) | 100 | 450 | 300 | 300 | 300 | 300 | 300 | 400 |
| C/(Si + C): | — | — | 0.04 | 0.10 | 0.34 | 0.47 | 0.56 | 0.61 |
| Rate of increase (%) defined by expression (1): | — | — | — | 150 | 240 | 38 | 19 | — |
| Layer thickness: (nm) | 2,500 | 35,000 | 80 | 60 | 70 | 80 | 210 | 1,000 |
| Total layer thickness (nm) of C/(Si + C) ≦ 0.35 intermediate layers: | — | — | | 210 | | — | — | — |

The C/(Si+C) and layer thickness of each of the intermediate layers and surface layer of the positive-charging electrophotographic photosensitive member thus produced were measured and calculated by the method described previously.

The electrophotographic photosensitive member thus produced was also evaluated in the following way on the items of delamination resistance 1, delamination resistance 2, surface layer wear level, sensitivity, sensitivity non-uniformity, and overall evaluation. Results obtained are shown in Table 11.

Delamination Resistance 1:

The electrophotographic photosensitive member produced was set in an electrophotographic apparatus (manufactured by CANON INC.; trade name: iRC6800), and, on its original glass plate, a test chart on the white background of which 2-point size characters were arranged over the whole surface was placed to take copies to conduct a 250,000-sheet continuous paper feed test. After the 250,000-sheet continuous paper feed test was finished, the electrophotographic photosensitive member was taken out of the electrophotographic apparatus, and this electrophotographic photosensitive member was observed on an optical microscope to examine whether or not any delamination had occurred between layers of the intermediate layers.

Results obtained were ranked according to the criteria shown below.

In virtue of the present invention, an effect ranked "A" was obtained.

A: Any delamination is not seen at all to have occurred.

B: Delamination is seen to have occurred, but images are not come influenced.

Delamination Resistance 2:

Delamination resistance between layers of the intermediate layers of the electrophotographic photosensitive member standing after the 250,000-sheet continuous paper feed test was conducted in the same way as in the evaluation of delamination resistance 1 was evaluated by using a wear tester (manufactured by Shinto Kagaku Kogyo K.K.; trade name: HEIDON (Type: 14S). Using this wear tester, the surface of the electrophotographic photosensitive member produced was scratched with a diamond needle, and the delamination resistance between layers of the intermediate layers was evaluated by the measure of a load applied to the diamond needle when the intermediate layers came to separate between layers.

In this method of evaluation, it shows that, the smaller the numerical value found is, the lower the delamination resistance between layers of the intermediate layers is.

Results obtained were ranked according to the criteria shown below, assuming the value of the electrophotographic photosensitive member of Example 1 as reference (100%).

In virtue of the present invention, an effect ranked "A" or higher was obtained.

AA: 105% or more, compared with the reference.

A: From 95% or more to less than 105%, compared with the reference.

B: Less than 95%, compared with the reference.

Surface Layer Wear Level:

As the evaluation of wear resistance of the surface layer, a difference was found between the layer thickness of the surface layer of the electrophotographic photosensitive member standing immediately after its production and the layer thickness of the surface layer of the electrophotographic photosensitive member standing after the 250,000-sheet continuous paper feed test was conducted, and this was taken as surface layer wear level standing after the 250,000-sheet continuous paper feed test.

The layer thickness of the surface layer of the electrophotographic photosensitive member standing immediately after its production was measured at 18 spots in total on the electrophotographic photosensitive member surface, and an average value was calculated from the values at the 18 spots. Positions of measurement were set at 9 spots on the electrophotographic photosensitive member in its lengthwise direction at an arbitrary position in the peripheral direction (on the basis of the exact middle of the electrophotographic photosensitive member in its lengthwise direction, at 0 mm and at 50 mm, 90 mm, 130 mm and 150 mm apart in both directions therefrom), and at 9 spots (the same as the above) in the lengthwise direction at a position rotated by 180° from the above arbitrary position.

As a measuring method, it was as follows: The surface of the electrophotographic photosensitive member was vertically irradiated with light in a spot diameter of 2 mm, and the reflected light was measure by spectrometry using a spectrometer (manufactured by Otuska Electronics Co., Ltd.; trade name: MCPD-2000). The layer thickness of the surface layer was calculated on the basis of reflection waveforms obtained. Here, the wavelength range was from 500 nm to 750 nm, the photoconductive layer had a refractive index of 3.30, and the surface layer had a refractive index of 1.80.

After the layer thickness of the surface layer was measured, the electrophotographic photosensitive member produced was set in the above electrophotographic apparatus, and, on its original glass plate, a test chart on the white background of which 2-point size characters were arranged over the whole surface was placed to take copies to conduct a 250,000-sheet continuous paper feed test. After the 250,000-sheet continuous paper feed test was finished, the electrophotographic photosensitive member was taken out of the electrophotographic apparatus, where the layer thickness of its surface layer was measured at the same position as that immediately after production. The layer thickness of the surface layer after the 250,000-sheet continuous paper feed test was calculated in the same way as that immediately after production, and then the above difference was found.

In this method of evaluation, it shows that, the smaller the numerical value found is, the lower the surface layer wear level is.

Results obtained were ranked according to the criteria shown below, assuming the value of the electrophotographic photosensitive member of Example 1 as reference (100%).

In virtue of the present invention, an effect ranked "A" or higher was obtained.

AA: Less than 95%, compared with the reference.

A: From 95% or more to less than 105%, compared with the reference.

B: 105% or more, compared with the reference.

Sensitivity:

The electrophotographic photosensitive member produced was set in the above electrophotographic apparatus. In the state the imagewise exposure was turned off, a high-pressure power source was connected to each of a wire and a grid of its charging assembly. Then, setting the grid potential at 820 V, the electric current flowed to the wire of the charging assembly was controlled so as to set the surface potential of the electrophotographic photosensitive members at 450 V.

Next, in the state the electrophotographic photosensitive member was charged under the charging conditions set as above, its surface was irradiated with imagewise exposure light, and its irradiation energy was controlled to set the surface potential of the electrophotographic photosensitive member at 50 V at the position of the developing assembly. The irradiation energy of the imagewise exposure light used here was evaluated as the sensitivity of the electrophotographic photosensitive member.

In this method of evaluation, it shows that, the smaller the numerical value found is, the higher sensitivity the electrophotographic photosensitive member has.

Results obtained were ranked according to the criteria shown below, assuming the value of the electrophotographic photosensitive member of Example 3-2 as reference (100%).

In virtue of the present invention, an effect ranked "A" or higher was obtained.

AAA: Less than 97%, compared with the reference.

AA: From 97% or more to less than 103%, compared with the reference.

A: From 103% or more to less than 107%, compared with the reference.

B: 107% or more, compared with the reference.

Sensitivity Non-Uniformity:

The electrophotographic photosensitive member produced was set in the above electrophotographic apparatus, and the charging electric current to be applied to the charging assembly was so adjusted that the dark-area potential of the surface of the electrophotographic photosensitive member came to be 450 V at the position of the developing assembly.

While this charging electric current was maintained, the surface of the electrophotographic photosensitive member was irradiated with imagewise exposure light (laser light), and the intensity of the imagewise exposure light was so adjusted that the light-area potential of the surface of the electrophotographic photosensitive member came to be 50 V at the position of the developing assembly. The intensity of the imagewise exposure light used here was fixed, and the surface potential obtained when, with this imagewise exposure light, the surface of the electrophotographic photosensitive member was irradiated at other portions of the surface was measured at 20 spots set arbitrarily on the surface of the electrophotographic photosensitive member. Among the positions of measurement, the worst value and best value obtained on characteristics, i.e., the maximum value and minimum value of potential were found, and the proportion of the maximum value to the minimum value was taken as a value showing sensitivity non-uniformity.

In this method of evaluation, it shows that, the larger the numerical value found is, the greater the sensitivity non-uniformity is.

Results obtained were ranked according to the criteria shown below, assuming the value of the electrophotographic photosensitive member of Example 4-1 as reference (100%).

In virtue of the present invention, an effect ranked "A" or higher was obtained.

AA: Less than 95%, compared with the reference.

A: From 95% or more to less than 105%, compared with the reference.

B: 105% or more, compared with the reference.

Overall Evaluation:

The results obtained in the evaluations of the delamination resistance 1, delamination resistance 2, surface layer wear level, sensitivity and sensitivity non-uniformity were ranked according to the criteria shown below, regarding the rank AAA as 3 points, the rank AA as 2 points, the rank A as 1 point and the rank B as 0 point, and these were totaled up. On the basis of the points thus obtained, the results were overall ranked in the following way.

In virtue of the present invention, an effect ranked "A" or higher was obtained.

AA: 9 points or more, and there is no rank B.

A: From 6 points or more to 8 points or less, and there is no rank B.

B: 5 points or less, or there is even one rank B at least.

Example 2

A positive-charging electrophotographic photosensitive member was produced in the same way as in Example 1 except that, in the procedure of Example 1, the surface layer and the intermediate layers were formed under conditions changed as shown in Table 2.

In this Example, a positive-charging electrophotographic photosensitive member having the layer configuration shown in FIG. 1A was produced.

The C/(Si+C) and layer thickness of each of the intermediate layers and surface layer of the positive-charging electrophotographic photosensitive member thus produced were measured and calculated in the same way as in Example 1. The electrophotographic photosensitive member thus produced was also evaluated in the same way as in Example 1. Results obtained are shown in Table 11.

TABLE 2

| Gases & Gas flow rates: | Change layer Intermediate layers: 1st | 2nd | 3rd | 4th | 5th | Surface layer |
|---|---|---|---|---|---|---|
| $SiH_4$ [ml/min(normal)] | 75 | 55 | 20 | 17 | 12 | 15 |
| $CH_4$ [ml/min(normal)] | 25 | 45 | 120 | 150 | 200 | 520 |
| Substrate temp.: (° C.) | 240 | 240 | 240 | 240 | 240 | 240 |
| Reactor internal pressure: (Pa) | 50 | 50 | 50 | 50 | 50 | 60 |
| High-frequency power: (W) | 300 | 300 | 300 | 300 | 300 | 400 |
| C/(Si + C): | 0.04 | 0.10 | 0.34 | 0.47 | 0.56 | 0.70 |
| Rate of increase (%) defined by expression (1): | — | 150 | 240 | 38 | 19 | — |
| Layer thickness: (nm) | 80 | 60 | 70 | 60 | 210 | 1,000 |
| Total layer thickness (nm) of C/(Si + C) ≦ 0.35 intermediate layers: | | 210 | | — | — | — |

Example 3-1

A positive-charging electrophotographic photosensitive member was produced in the same way as in Example 1 except that, in the procedure of Example 1, the surface layer and the intermediate layers were formed under conditions changed as shown in Table 3.

In this Example, a positive-charging electrophotographic photosensitive member having the layer configuration shown in FIG. 1C was produced.

The C/(Si+C) and layer thickness of each of the intermediate layers and surface layer of the positive-charging electrophotographic photosensitive member thus produced were measured and calculated in the same way as in Example 1. The electrophotographic photosensitive member thus produced was also evaluated in the same way as in Example 1. Results obtained are shown in Table 11.

TABLE 3

| Gases & Gas flow rates: | Change layer Intermediate layers: 1st | 2nd | 3rd | 4th | 5th | 6th | 7th | 8th | 9th | Surface layer |
|---|---|---|---|---|---|---|---|---|---|---|
| $SiH_4$ [ml/min(normal)] | 75 | 63 | 38 | 22 | 20 | 18 | 15 | 10 | 10 | 13 |
| $CH_4$ [ml/min(normal)] | 25 | 63 | 88 | 125 | 125 | 145 | 188 | 225 | 300 | 600 |
| Substrate temp.: (° C.) | 240 | 240 | 240 | 240 | 240 | 240 | 240 | 240 | 240 | 240 |
| Reactor internal pressure: (Pa) | 50 | 50 | 50 | 50 | 50 | 50 | 50 | 50 | 50 | 60 |
| High-frequency power: (W) | 300 | 300 | 300 | 300 | 300 | 300 | 300 | 300 | 300 | 400 |
| C/(Si + C): | 0.04 | 0.10 | 0.15 | 0.35 | 0.37 | 0.44 | 0.52 | 0.60 | 0.68 | 0.72 |
| Rate of increase (%) defined by expression (1): | — | 150 | 50 | 133 | 6 | 19 | 18 | 15 | 13 | — |
| Layer thickness: (nm) | 80 | 60 | 50 | 20 | 40 | 30 | 10 | 210 | 200 | 1,000 |
| Total layer thickness (nm) of C/(Si + C) ≦ 0.35 intermediate layers: | | 210 | | | — | — | — | — | — | — |

Example 3-2

A positive-charging electrophotographic photosensitive member was produced in the same way as in Example 1 except that, in the procedure of Example 1, the surface layer and the intermediate layers were formed under conditions changed as shown in Table 4.

In this Example, a positive-charging electrophotographic photosensitive member having the layer configuration shown in FIG. 1C was produced, provided that the change layer was made into a layer consisting of 15-layer intermediate layers.

The C/(Si+C) and layer thickness of each of the intermediate layers and surface layer of the positive-charging electrophotographic photosensitive member thus produced were measured and calculated in the same way as in Example 1. The electrophotographic photosensitive member thus produced was also evaluated in the same way as in Example 1. Results obtained are shown in Table 11.

Example 4-1

A positive-charging electrophotographic photosensitive member was produced in the same way as in Example 1 except that, in the procedure of Example 1, the surface layer and the intermediate layers were formed under conditions changed as shown in Table 5.

In this Example, a positive-charging electrophotographic photosensitive member having the layer configuration shown in FIG. 1C was produced.

The C/(Si+C) and layer thickness of each of the intermediate layers and surface layer of the positive-charging electrophotographic photosensitive member thus produced were measured and calculated in the same way as in Example 1. The electrophotographic photosensitive member thus produced was also evaluated in the same way as in Example 1. Results obtained are shown in Table 11.

TABLE 4

| Gases & Gas flow rates: | Change layer Intermediate layers: 1st | 2nd | 3rd | 4th | 5th | 6th | 7th | 8th | 9th | 10th | 11th | 12th | 13th | 14th | 15th | Surface layer |
|---|---|---|---|---|---|---|---|---|---|---|---|---|---|---|---|---|
| $SiH_4$ [ml/min (normal)] | 75 | 63 | 38 | 38 | 30 | 25 | 25 | 22 | 15 | 15 | 15 | 12 | 10 | 10 | 10 | 13 |
| $CH_4$ [ml/min (normal)] | 25 | 63 | 88 | 120 | 120 | 120 | 130 | 125 | 130 | 140 | 150 | 180 | 210 | 240 | 300 | 600 |
| Substrate temp.: (° C.) | 240 | 240 | 240 | 240 | 240 | 240 | 240 | 240 | 240 | 240 | 240 | 240 | 240 | 240 | 240 | 240 |
| Reactor internal pressure: (Pa) | 50 | 50 | 50 | 50 | 50 | 50 | 50 | 50 | 50 | 50 | 50 | 50 | 50 | 50 | 50 | 60 |
| High-frequency power: (W) | 300 | 300 | 300 | 300 | 300 | 300 | 300 | 300 | 300 | 300 | 300 | 300 | 300 | 300 | 300 | 400 |
| C/(Si + C): | 0.04 | 0.10 | 0.15 | 0.20 | 0.22 | 0.29 | 0.31 | 0.35 | 0.41 | 0.43 | 0.47 | 0.56 | 0.59 | 0.63 | 0.68 | 0.72 |
| Rate of increase (%) defined by expression (1): | — | 150 | 50 | 33 | 10 | 32 | 7 | 13 | 17 | 5 | 9 | 19 | 5 | 7 | 8 | — |
| Layer thickness: (nm) | 20 | 30 | 30 | 20 | 20 | 30 | 30 | 30 | 20 | 50 | 10 | 50 | 210 | 100 | 200 | 1,000 |
| Total layer thickness (nm) of C/(Si + C) ≦ 0.35 intermediate layers: | | | | | 210 | | | | — | — | — | — | — | — | — | — |

TABLE 5

| Gases & Gas flow rates: | Change layer Intermediate layers: 1st | 2nd | 3rd | 4th | 5th | 6th | 7th | 8th | 9th | Surface layer |
|---|---|---|---|---|---|---|---|---|---|---|
| $SiH_4$ [ml/min(normal)] | 75 | 63 | 38 | 22 | 20 | 18 | 15 | 10 | 10 | 13 |
| $CH_4$ [ml/min(normal)] | 25 | 63 | 88 | 125 | 125 | 145 | 188 | 225 | 300 | 600 |
| Substrate temp.: (° C.) | 240 | 240 | 240 | 240 | 240 | 240 | 240 | 240 | 240 | 240 |
| Reactor internal pressure: (Pa) | 50 | 50 | 50 | 50 | 50 | 50 | 50 | 50 | 50 | 60 |
| High-frequency power: (W) | 300 | 300 | 300 | 300 | 300 | 300 | 300 | 300 | 300 | 400 |
| C/(Si + C): | 0.04 | 0.10 | 0.15 | 0.35 | 0.37 | 0.44 | 0.52 | 0.60 | 0.68 | 0.72 |
| Rate of increase (%) defined by expression (1): | — | 150 | 50 | 133 | 6 | 19 | 18 | 15 | 13 | — |
| Layer thickness: (nm) | 80 | 60 | 50 | 20 | 40 | 8 | 20 | 190 | 200 | 1,000 |
| Total layer thickness (nm) of C/(Si + C) ≦ 0.35 intermediate layers: | 210 | | | | — | — | — | — | — | — |

Example 4-2

A positive-charging electrophotographic photosensitive member was produced in the same way as in Example 1 except that, in the procedure of Example 1, the surface layer and the intermediate layers were formed under conditions changed as shown in Table 6.

In this Example, a positive-charging electrophotographic photosensitive member having the layer configuration shown in FIG. 1C was produced.

The C/(Si+C) and layer thickness of each of the intermediate layers and surface layer of the positive-charging electrophotographic photosensitive member thus produced were measured and calculated in the same way as in Example 1. The electrophotographic photosensitive member thus produced was also evaluated in the same way as in Example 1. Results obtained are shown in Table 11.

TABLE 6

| Gases & Gas flow rates: | Change layer Intermediate layers: 1st | 2nd | 3rd | 4th | 5th | 6th | 7th | 8th | 9th | Surface layer |
|---|---|---|---|---|---|---|---|---|---|---|
| $SiH_4$ [ml/min(normal)] | 75 | 63 | 38 | 22 | 20 | 18 | 15 | 10 | 10 | 13 |
| $CH_4$ [ml/min(normal)] | 25 | 63 | 88 | 125 | 125 | 145 | 188 | 225 | 300 | 600 |
| Substrate temp.: (° C.) | 240 | 240 | 240 | 240 | 240 | 240 | 240 | 240 | 240 | 240 |
| Reactor internal pressure: (Pa) | 50 | 50 | 50 | 50 | 50 | 50 | 50 | 50 | 50 | 60 |
| High-frequency power: (W) | 300 | 300 | 300 | 300 | 300 | 300 | 300 | 300 | 300 | 400 |
| C/(Si + C): | 0.04 | 0.10 | 0.15 | 0.35 | 0.37 | 0.44 | 0.52 | 0.60 | 0.68 | 0.72 |
| Rate of increase (%) defined by expression (1): | — | 150 | 50 | 133 | 6 | 19 | 18 | 15 | 13 | — |
| Layer thickness: (nm) | 80 | 40 | 50 | 40 | 40 | 10 | 20 | 190 | 200 | 1,000 |
| Total layer thickness (nm) of C/(Si + C) ≦ 0.35 intermediate layers: | 210 | | | | — | — | — | — | — | — |

Example 5-1

A positive-charging electrophotographic photosensitive member was produced in the same way as in Example 1 except that, in the procedure of Example 1, the surface layer and the intermediate layers were formed under conditions changed as shown in Table 7.

In this Example, a positive-charging electrophotographic photosensitive member having the layer configuration shown in FIG. 1C was produced.

The C/(Si+C) and layer thickness of each of the intermediate layers and surface layer of the positive-charging electrophotographic photosensitive member thus produced were measured and calculated in the same way as in Example 1. The electrophotographic photosensitive member thus produced was also evaluated in the same way as in Example 1. Results obtained are shown in Table 11.

TABLE 7

| Gases & | Change layer Intermediate layers: | | | | | | | | | Surface |
|---|---|---|---|---|---|---|---|---|---|---|
| Gas flow rates: | 1st | 2nd | 3rd | 4th | 5th | 6th | 7th | 8th | 9th | layer |
| $SiH_4$ [ml/min(normal)] | 75 | 63 | 38 | 22 | 20 | 15 | 15 | 12 | 10 | 15 |
| $CH_4$ [ml/min(normal)] | 25 | 63 | 88 | 120 | 125 | 140 | 150 | 180 | 200 | 450 |
| Substrate temp.: (° C.) | 240 | 240 | 240 | 240 | 240 | 240 | 240 | 240 | 240 | 240 |
| Reactor internal pressure: (Pa) | 50 | 50 | 50 | 50 | 50 | 50 | 50 | 50 | 50 | 60 |
| High-frequency power: (W) | 300 | 300 | 300 | 300 | 300 | 300 | 300 | 300 | 300 | 400 |
| C/(Si + C): | 0.04 | 0.10 | 0.15 | 0.35 | 0.37 | 0.43 | 0.49 | 0.55 | 0.58 | 0.61 |
| Rate of increase (%) defined by expression (1): | — | 150 | 50 | 133 | 6 | 16 | 14 | 12 | 5 | — |
| Layer thickness: (nm) | 80 | 40 | 40 | 40 | 40 | 10 | 40 | 190 | 200 | 1,000 |
| Total layer thickness (nm) of C/(Si + C) ≦ 0.35 intermediate layers: | 200 | | | | — | — | — | — | — | — |

Example 5-2

A positive-charging electrophotographic photosensitive member was produced in the same way as in Example 1 except that, in the procedure of Example 1, the surface layer and the intermediate layers were formed under conditions changed as shown in Table 8.

In this Example, a positive-charging electrophotographic photosensitive member having the layer configuration shown in FIG. 1C was produced.

The C/(Si+C) and layer thickness of each of the intermediate layers and surface layer of the positive-charging electrophotographic photosensitive member thus produced were measured and calculated in the same way as in Example 1. The electrophotographic photosensitive member thus produced was also evaluated in the same way as in Example 1. Results obtained are shown in Table 11.

TABLE 8

| Gases & | Change layer Intermediate layers: | | | | | | | | | Surface |
|---|---|---|---|---|---|---|---|---|---|---|
| Gas flow rates: | 1st | 2nd | 3rd | 4th | 5th | 6th | 7th | 8th | 9th | layer |
| $SiH_4$ [ml/min(normal)] | 75 | 63 | 38 | 22 | 20 | 18 | 15 | 10 | 10 | 13 |
| $CH_4$ [ml/min(normal)] | 25 | 63 | 88 | 125 | 125 | 145 | 188 | 225 | 300 | 600 |
| Substrate temp.: (° C.) | 240 | 240 | 240 | 240 | 240 | 240 | 240 | 240 | 240 | 240 |
| Reactor internal pressure: (Pa) | 50 | 50 | 50 | 50 | 50 | 50 | 50 | 50 | 50 | 60 |
| High-frequency power: (W) | 300 | 300 | 300 | 300 | 300 | 300 | 300 | 300 | 300 | 400 |
| C/(Si + C): | 0.04 | 0.10 | 0.15 | 0.35 | 0.37 | 0.44 | 0.52 | 0.60 | 0.68 | 0.72 |

TABLE 8-continued

| Gases & Gas flow rates: | Change layer Intermediate layers: 1st | 2nd | 3rd | 4th | 5th | 6th | 7th | 8th | 9th | Surface layer |
|---|---|---|---|---|---|---|---|---|---|---|
| Rate of increase (%) defined by expression (1): | — | 150 | 50 | 133 | 6 | 19 | 18 | 15 | 13 | — |
| Layer thickness: (nm) | 80 | 40 | 40 | 40 | 40 | 10 | 40 | 190 | 200 | 1,000 |
| Total layer thickness (nm) of C/(Si + C) ≦ 0.35 intermediate layers: | | 200 | | | — | — | — | — | — | — |

Comparative Example 1

A positive-charging electrophotographic photosensitive member was produced in the same way as in Example 1 except that, in the procedure of Example 1, the surface layer and the intermediate layers were formed under conditions changed as shown in Table 9.

In this Comparative Example, a positive-charging electrophotographic photosensitive member having the layer configuration shown in FIG. 1A was produced.

The C/(Si+C) and layer thickness of each of the intermediate layers and surface layer of the positive-charging electrophotographic photosensitive member thus produced were measured and calculated in the same way as in Example 1. The electrophotographic photosensitive member thus produced was also evaluated in the same way as in Example 1. Results obtained are shown in Table 11.

TABLE 9

| Gases & Gas flow rates: | Change layer Intermediate layers: 1st | 2nd | 3rd | 4th | 5th | Surface layer |
|---|---|---|---|---|---|---|
| $SiH_4$ [ml/min(normal)] | 75 | 55 | 20 | 15 | 12 | 15 |
| $CH_4$ [ml/min(normal)] | 25 | 45 | 120 | 140 | 170 | 450 |
| Substrate temp.: (° C.) | 240 | 240 | 240 | 240 | 240 | 240 |
| Reactor internal pressure: (Pa) | 50 | 50 | 50 | 50 | 50 | 60 |
| High-frequency power: (W) | 300 | 300 | 300 | 300 | 300 | 400 |
| C/(Si + C): | 0.04 | 0.10 | 0.34 | 0.43 | 0.54 | 0.61 |
| Rate of increase (%) defined by expression (1): | — | 150 | 240 | 26 | 26 | — |
| Layer thickness: (nm) | 80 | 60 | 70 | 80 | 210 | 1,000 |
| Total layer thickness (nm) of C/(Si + C) ≦ 0.35 intermediate layers: | | 210 | | — | — | — |

Comparative Example 2

A positive-charging electrophotographic photosensitive member was produced in the same way as in Example 1 except that, in the procedure of Example 1, the surface layer and the intermediate layers were formed under conditions changed as shown in Table 10.

In this Comparative Example, a positive-charging electrophotographic photosensitive member having the layer configuration shown in FIG. 1A was produced.

The C/(Si+C) and layer thickness of each of the intermediate layers and surface layer of the positive-charging electrophotographic photosensitive member thus produced were measured and calculated in the same way as in Example 1. The electrophotographic photosensitive member thus produced was also evaluated in the same way as in Example 1. Results obtained are shown in Table 11.

TABLE 10

| Gases & Gas flow rates: | Change layer Intermediate layers: 1st | 2nd | 3rd | 4th | 5th | Surface layer |
|---|---|---|---|---|---|---|
| $SiH_4$ [ml/min(normal)] | 75 | 55 | 20 | 17 | 12 | 10 |
| $CH_4$ [ml/min(normal)] | 25 | 45 | 120 | 150 | 200 | 200 |
| Substrate temp.: (° C.) | 240 | 240 | 240 | 240 | 240 | 240 |
| Reactor internal pressure: (Pa) | 50 | 50 | 50 | 50 | 50 | 60 |
| High-frequency power: (W) | 300 | 300 | 300 | 300 | 300 | 400 |
| C/(Si + C): | 0.04 | 0.10 | 0.34 | 0.47 | 0.56 | 0.58 |
| Rate of increase (%) defined by expression (1): | — | 150 | 240 | 38 | 19 | — |
| Layer thickness: (nm) | 80 | 60 | 70 | 80 | 210 | 1,000 |
| Total layer thickness (nm) of C/(Si + C) ≦ 0.35 intermediate layers: | | 210 | | — | — | — |

TABLE 11

| | Delamination resistance 1 | Delamination resistance 2 | Surface layer wear level | Sensitivity | Sensitivity non-uniformity | Overall evaluation |
|---|---|---|---|---|---|---|
| Example: | | | | | | |
| 1 | A | A | A | AA | AA | A |
| 2 | A | A | AA | AA | AA | A |
| 3-1 | A | A | AA | AA | AA | A |
| 3-2 | A | A | AA | A | AA | A |
| 4-1 | A | AA | AA | AA | A | A |
| 4-2 | A | AA | AA | AA | AA | AA |
| 5-1 | A | AA | A | AAA | AA | AA |
| 5-2 | A | AA | AA | AAA | AA | AA |
| Comparative Example: | | | | | | |
| 1 | B | B | A | AA | AA | B |
| 2 | A | A | B | AA | AA | B |

How the present invention is effective is explained below on the basis of the results shown in Table 11.

It is seen from Example 1 and Comparative Example 1 that both the delamination resistance 1 and the delamination resistance 2 can be good and the a-SiC intermediate layers can not easily come to separate between their layers (cause delamination) when, where, among the intermediate layers included in the change layer, two layers contiguous to each other are selected from among intermediate layers in which the C/(Si+C) is in the range of from 0.35 or more to 0.65 or less, and, between the two layers contiguous to each other, the C/(Si+C) in an intermediate layer on the photoconductive layer side is represented by A and the C/(Si+C) in an intermediate layer on the surface layer side is represented by B, the rate of increase between layers as defined by the expression (1) is 19% or less.

It is also seen from Example 1 and Comparative Example 2 that the surface layer wear level can be small and the electrophotographic photosensitive member can be improved in its wear resistance when the C/(Si+C) in the surface layer is from 0.61 or more to 0.90 or less.

It is still also seen from Example 1 and Example 2 that the surface layer wear level can especially be smaller and the electrophotographic photosensitive member can be more improved in its wear resistance when the C/(Si+C) in the surface layer is from 0.70 or more to 0.90 or less.

It is still also seen from Example 3-1 and Example 3-2 that the electrophotographic photosensitive member can be kept from lowering in sensitivity when the number of layers of the a-SiC intermediate layers included in the change layer is nine layers or less. Thus, it is seen that the number of layers of the a-SiC intermediate layers included in the change layer may preferably be five layers or more to nine layers or less.

It is still also seen from Example 4-1 and Example 4-2 that the electrophotographic photosensitive member can be kept from non-uniform sensitivity when the a-SiC intermediate layers included in the change layer each have a layer thickness of 10 nm or more. It is also seen from Example 4-2 and Example 3-1 that the a-SiC intermediate layers can more not easily come to separate between their layers when the a-SiC intermediate layers included in the change layer each have a layer thickness of 200 nm or less. Thus, it is seen that the a-SiC intermediate layers included in the change layer may each preferably have a layer thickness of from 10 nm or more to 200 nm or less.

It is still also seen from Example 5-2 and Example 4-2 that the electrophotographic photosensitive member can be kept from lowering in sensitivity when any a-SiC intermediate layers in which the C/(Si+C) is 0.35 or less have a layer thickness of 200 nm or less in total.

Example 6

Using as a substrate (a conductive substrate) a cylinder obtained by mirror-finishing the surface of a pipe section made of aluminum and being 84 mm in diameter, 381 mm in length and 3 mm in wall thickness, a negative-charging electrophotographic photosensitive member was produced by using the deposited-film forming apparatus shown in FIG. 3.

In this Example, a negative-charging electrophotographic photosensitive member having the layer configuration shown in FIG. 1A was produced.

Conditions for forming respective layers (film forming conditions) are shown in Table 12. In Table 12, the layer thickness of each layer shows a designed value for each layer.

TABLE 12

| Gases & Gas flow rates: | Lower-part charge injection blocking layer | Photo-conductive layer | Change layer Intermediate layers: 1st | 2nd | 3rd | 4th | 5th | Surface layer |
|---|---|---|---|---|---|---|---|---|
| $SiH_4$ [ml/min(normal)] | 80 | 85 | 75 | 55 | 20 | 17 | 12 | 15 |
| $H_2$ [ml/min(normal)] | 480 | 680 | — | — | — | — | — | — |
| $B_2H_6$ (ppm) (based on $SiH_4$) | — | — | — | 150 | 150 | 150 | — | — |
| NO (%) (based on $SiH_4$) | 5 | — | — | — | — | — | — | — |
| $CH_4$ [ml/min(normal)] | — | — | 25 | 45 | 120 | 150 | 200 | 450 |
| Substrate temp.: (° C.) | 270 | 260 | 240 | 240 | 240 | 240 | 240 | 240 |
| Reactor internal pressure: (Pa) | 80 | 80 | 50 | 50 | 50 | 50 | 50 | 60 |
| High-frequency power: (W) | 100 | 450 | 300 | 300 | 300 | 300 | 300 | 400 |
| C/(Si + C): | — | — | 0.04 | 0.10 | 0.34 | 0.47 | 0.56 | 0.61 |
| Rate of increase (%) defined by expression (1): | — | — | — | 150 | 240 | 38 | 19 | — |
| Layer thickness: (nm) | 2,500 | 35,000 | 80 | 60 | 70 | 80 | 210 | 1,000 |
| Total layer thickness (nm) of C/(Si + C) ≦ 0.35 intermediate layers: | — | — | | 210 | | — | — | — |

The C/(Si+C) and layer thickness of each of the intermediate layers and surface layer of the negative-charging electrophotographic photosensitive member thus produced were measured and calculated by the method described previously.

The electrophotographic photosensitive member thus produced was also evaluated in the following way on the items of delamination resistance 1, delamination resistance 2, blurred images, surface layer wear level, sensitivity, potential non-uniformity, chargeability, and overall evaluation. Results obtained are shown in Table 28.

Delamination Resistance 1:

The electrophotographic photosensitive member produced was set in a conversion machine of an electrophotographic apparatus (manufactured by CANON INC.; trade name: iRC6800), and, on its original glass plate, a test chart on the white background of which 2-point size characters were arranged over the whole surface was placed to take copies to conduct a 250,000-sheet continuous paper feed test. After the 250,000-sheet continuous paper feed test was finished, the electrophotographic photosensitive member was taken out of the electrophotographic apparatus, and this electrophotographic photosensitive member was observed on an optical microscope to examine whether or not any delamination had occurred between layers of the intermediate layers. The conversion machine of an electrophotographic apparatus (manufactured by CANON INC.; trade name: iRC6800), used here, is one in which the charge polarity of the surface of the electrophotographic photosensitive member was changed to be of negative charging and the charging assembly was changed for a contact charging assembly having magnetic particles provided in contact with the surface of the electrophotographic photosensitive member. Regarding the evaluation on blurred images and surface layer wear level described later, too, the electrophotographic apparatus was used which was converted in the same way.

Results obtained were ranked according to the criteria shown below.

A: Any delamination is not seen at all to have occurred.

B: Delamination is seen to have occurred, but images are not come influenced.

Delamination Resistance 2:

The electrophotographic photosensitive member standing after the delamination resistance 1 was evaluated was set in a wear tester (manufactured by Shinto Kagaku Kogyo K.K.; trade name: HEIDON (Type: 14S). Using this wear tester, the surface of the electrophotographic photosensitive member was scratched with a diamond needle, and the delamination resistance between layers of the intermediate layers was evaluated by the measure of a load applied to the diamond needle when the intermediate layers came to separate between layers.

In this method of evaluation, it shows that, the smaller the numerical value found is, the lower the delamination resistance between layers of the intermediate layers is.

Results obtained were ranked according to the criteria shown below, assuming the value of the electrophotographic photosensitive member of Example 6 as reference (100%).

In virtue of the present invention, an effect ranked "A" or higher was obtained.

AA: 105% or more, compared with the reference.

A: From 95% or more to less than 105%, compared with the reference.

B: Less than 95%, compared with the reference.

Blurred Images:

Using an image editing software ADOBE PHOTOSHOP (trade name), available from Adobe Systems Incorporated, and, at a resolution of 1,200 dpi and using an area coverage modulation dot screen in which dots were arranged at a line density of 170 lpi (170 lines per 1 inch) in the direction of 45 degrees, gradation data were prepared in which the whole gradation range was equally distributed at 17 stages. Here, a number was so allotted for each gradation as to give a number "16" to the darkest gradation and a number "0" to the lightest gradation to make gradation stages.

The electrophotographic photosensitive member produced was set in the above conversion machine of the electrophotographic apparatus, and images were reproduced on A3-size sheets by using the above gradation data and using a text mode. On the images obtained, image density was measured with a reflection densitometer (a spectro-densitometer X-rite 504, manufactured by X-rite, Incorporated) for each gradation. In the measurement of reflection density, images were reproduced on three sheets for each gradation, and an average value of their densities was taken as an evaluation value.

A correlation coefficient between the evaluation value thus found and each gradation stage was calculated, and the correlation coefficient found was used to make evaluation as blurred images. The correlation coefficient is 1.00 where the representation of gradation in which the reflection density at each gradation changes perfectly linearly is obtained.

In this evaluation, it shows that, the smaller the numerical value is, the less the blurred images occur and the more closely linearly the gradation is represented.

AA: The correlation coefficient is 1.5 or less.

A: The correlation coefficient is more than 1.5 and 1.8 or less.

B: The correlation coefficient is more than 1.8.

Surface Layer Wear Level:

First, the electrophotographic photosensitive member produced was set in the above conversion machine of the electrophotographic apparatus, and, on its original glass plate, a test chart on the white background of which 2-point size characters were arranged over the whole surface was placed to take copies to conduct a 250,000-sheet continuous paper feed test. Then, a 100,000-sheet continuous paper feed test was conducted, and thereafter the layer thickness of the surface layer of the electrophotographic photosensitive member was measured in the same way as in Example 1 by using a spectrometer (manufactured by Otuska Electronics Co., Ltd.; trade name: MCPD-2000). A difference between the layer thickness of the surface layer of the electrophotographic photosensitive member standing before the 100,000-sheet continuous paper feed test was conducted and the layer thickness of the surface layer of the electrophotographic photosensitive member standing after it was conducted was found, and this was taken as the surface layer wear level after 100,000-sheet continuous paper feed test.

In this method of evaluation, it shows that, the smaller the numerical value found is, the lower the surface layer wear level is.

Results obtained were ranked according to the criteria shown below, assuming the value of the electrophotographic photosensitive member of Example 6 as reference (100%)

In virtue of the present invention, an effect ranked "A" or higher was obtained.

AA: Less than 95, compared with the reference.

A: From 95% or more to less than 105%, compared with the reference.

B: 105% or more, compared with the reference.

Sensitivity:

The electrophotographic photosensitive member produced was set in the above conversion machine of the electrophotographic apparatus, and, at the position of its black developing assembly, the surface of the electrophotographic photosensitive member was so charged electrostatically that the dark-area potential of the surface of the electrophotographic photosensitive member at its middle position of the axial direction came to be −450 V. Then, at the position of the black developing assembly, the amount of light of imagewise exposure light was so adjusted that the light-area potential of the surface of the electrophotographic photosensitive member at its middle position of the axial direction came to be −100 V. The amount of light of imagewise exposure light at this point was evaluated as the sensitivity of the electrophotographic photosensitive member. Incidentally, in this evaluation, as a further conversion machine of the above conversion machine of the electrophotographic apparatus, the imagewise exposure light was so changed that its amount of light was adjustable and the black developing assembly was changed for a surface potentiometer. The same applies also to a conversion machine of the electrophotographic apparatus as used in the evaluation on potential non-uniformity described later.

In this method of evaluation, it shows that, the smaller the numerical value found is, the higher sensitivity the electrophotographic photosensitive member has.

Results obtained were ranked according to the criteria shown below, assuming the value of the electrophotographic photosensitive member of Example 8-2 as reference (100%).

AAA: Less than 93%, compared with the reference.

AA: From 93% or more to less than 97%, compared with the reference.

A: From 97% or more to less than 103%, compared with the reference.

Potential Non-Uniformity:

The electrophotographic photosensitive member produced was set in a conversion machine (the same conversion as in the evaluation of sensitivity) of the above electrophotographic apparatus. Its charging assembly was so adjusted that the dark-area potential of the surface of the electrophotographic photosensitive member came to be −450 V at the position of the black developing assembly, and the amount of light of imagewise exposure light was so adjusted that the light-area potential of the surface of the electrophotographic photosensitive member came to be −100 V at the position of the black developing assembly. In this state, how the light-area potential stood distributed on the surface of the electrophotographic photosensitive member was measured, and a difference between its maximum value and its minimum value was taken as potential non-uniformity.

In this evaluation item, it shows that, the smaller the difference between the maximum value and the minimum value is, the smaller the potential non-uniformity is.

Results obtained were ranked according to the criteria shown below, assuming the value of the electrophotographic photosensitive member of Example 9-1 as reference (100%).

AA: Less than 95%, compared with the reference.

A: From 95% or more to less than 105%, compared with the reference.

Figure 4:
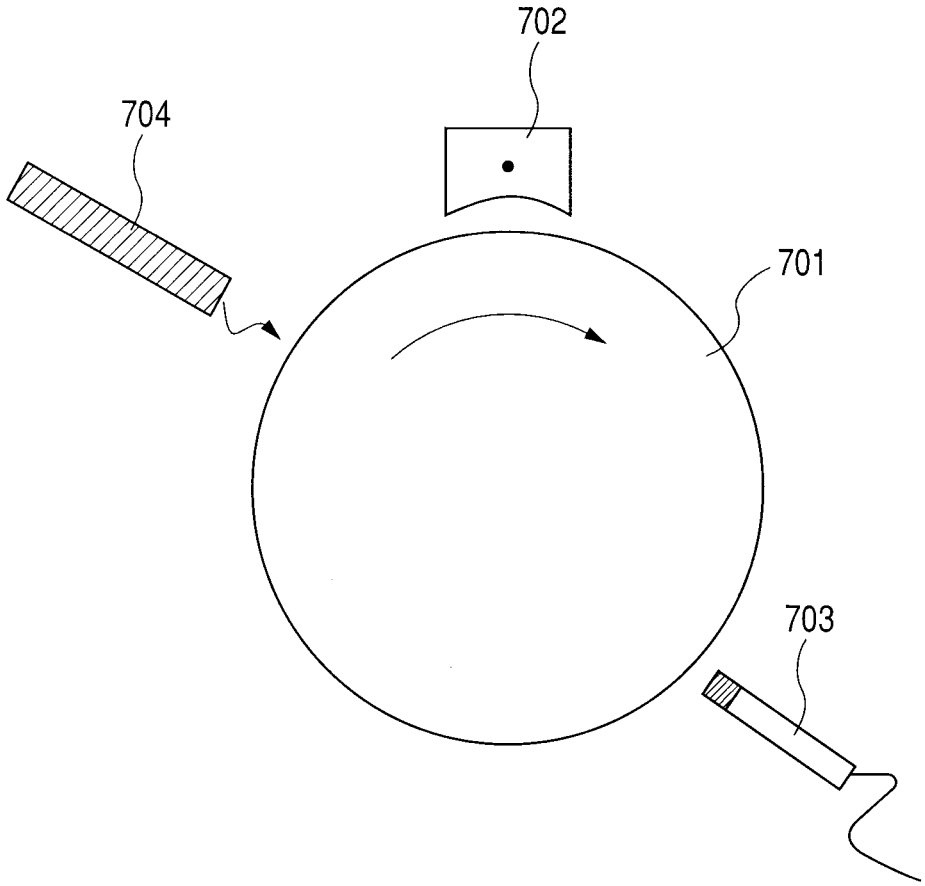
FIG. 4 is a view showing a chargeability measuring unit.

Chargeability:

The electrophotographic photosensitive member produced was set in a chargeability measuring unit shown in FIG. 4, and an electrophotographic photosensitive member 701 was provided on its surface with negative electric charges of −6,000 $\mu C/m^2$ by using a negative-charging corona charging assembly 702. Thereafter, the surface potential of the electrophotographic photosensitive member 701 after its leaving for 0.18 second was measured with a surface potentiometer 703, and was taken as the chargeability of the electrophotographic photosensitive member 701.

In this evaluation item, it shows that, the higher the surface potential of the electrophotographic photosensitive member 701 after its leaving for 0.18 second is, the better its chargeability is.

Results obtained were ranked according to the criteria shown below, assuming the value of the electrophotographic photosensitive member of Example 12-1 as reference (100%).

AA: From 110% or more to less than 120%, compared with the reference.

A: From 90% or more to less than 110%, compared with the reference.

Overall Evaluation:

The results obtained in the evaluations of the delamination resistance 1, delamination resistance 2, blurred images, surface layer wear level, sensitivity, potential non-uniformity and chargeability were ranked according to the criteria shown below, regarding the rank AAA as 3 points, the rank AA as 2 points, the rank A as 1 point and the rank B as 0 point, and these were totaled up. On the basis of the points thus obtained, the results were overall ranked in the following way.

AA: 13 points or more to 14 points or less, and there is no rank B.

A: From 10 points or more to 12 points or less, and there is no rank B.

B: 9 points or less, and there is even one rank B at least.

Here, in the every evaluation item and overall evaluation, the effect of the present invention is judged to have been obtained when ranked "A" or higher.

Example 7

A negative-charging electrophotographic photosensitive member was produced in the same way as in Example 6 except that, in the procedure of Example 6, the surface layer and the intermediate layers were formed under conditions changed as shown in Table 13.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

TABLE 13

| Gases & | Change layer Intermediate layers: | | | | | Surface |
|---|---|---|---|---|---|---|
| Gas flow rates: | 1st | 2nd | 3rd | 4th | 5th | layer |
| $SiH_4$ [ml/min(normal)] | 75 | 55 | 20 | 17 | 12 | 15 |
| $B_2H_6$ (ppm) (based on $SiH_4$) | — | 180 | 180 | — | — | — |
| $CH_4$ [ml/min(normal)] | 25 | 45 | 120 | 150 | 200 | 520 |
| Substrate temp.: (° C.) | 240 | 240 | 240 | 240 | 240 | 240 |
| Reactor internal pressure: (Pa) | 50 | 50 | 50 | 50 | 50 | 60 |
| High-frequency power: (W) | 300 | 300 | 300 | 300 | 300 | 400 |
| C/(Si + C): | 0.04 | 0.10 | 0.34 | 0.47 | 0.56 | 0.70 |
| Rate of increase (%) defined by expression (1): | — | 150 | 240 | 38 | 19 | — |
| Layer thickness: (nm) | 80 | 60 | 70 | 60 | 210 | 1,000 |
| Total layer thickness (nm) of C/(Si + C) ≦ 0.35 intermediate layers: | | 210 | | — | — | — |

Example 8-1

A negative-charging electrophotographic photosensitive member was produced in the same way as in Example 6 except that, in the procedure of Example 6, the surface layer and the intermediate layers were formed under conditions changed as shown in Table 14.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

TABLE 14

| Gases & | Change layer Intermediate layers: | | | | | | | | | Surface |
|---|---|---|---|---|---|---|---|---|---|---|
| Gas flow rates: | 1st | 2nd | 3rd | 4th | 5th | 6th | 7th | 8th | 9th | layer |
| $SiH_4$ [ml/min(normal)] | 75 | 63 | 38 | 22 | 20 | 18 | 15 | 10 | 10 | 13 |
| $B_2H_6$ (ppm) (based on $SiH_4$) | — | 100 | 200 | 100 | — | — | — | — | — | — |
| $CH_4$ [ml/min(normal)] | 25 | 63 | 88 | 125 | 125 | 145 | 188 | 225 | 300 | 600 |
| Substrate temp.: (° C.) | 240 | 240 | 240 | 240 | 240 | 240 | 240 | 240 | 240 | 240 |
| Reactor internal pressure: (Pa) | 50 | 50 | 50 | 50 | 50 | 50 | 50 | 50 | 50 | 60 |
| High-frequency power: (W) | 300 | 300 | 300 | 300 | 300 | 300 | 300 | 300 | 300 | 400 |
| C/(Si + C): | 0.04 | 0.10 | 0.15 | 0.35 | 0.37 | 0.44 | 0.52 | 0.60 | 0.68 | 0.72 |
| Rate of increase (%) defined by expression (1): | — | 150 | 50 | 133 | 6 | 19 | 18 | 15 | 13 | — |
| Layer thickness: (nm) | 80 | 60 | 50 | 20 | 40 | 30 | 10 | 210 | 200 | 1,000 |
| Total layer thickness (nm) of C/(Si + C) ≦ 0.35 intermediate layers: | | | 210 | | — | — | — | — | — | — |

Example 8-2

A negative-charging electrophotographic photosensitive member was produced in the same way as in Example 6 except that, in the procedure of Example 6, the surface layer and the intermediate layers were formed under conditions changed as shown in Table 15.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

TABLE 15

| Gases & | Change layer Intermediate layers: | | | | | | | | |
|---|---|---|---|---|---|---|---|---|---|
| Gas flow rates: | 1st | 2nd | 3rd | 4th | 5th | 6th | 7th | 8th | 9th |
| $SiH_4$ [ml/min(normal)] | 75 | 63 | 38 | 38 | 30 | 25 | 25 | 22 | 15 |
| $B_2H_6$ (ppm) (based on $SiH_4$) | — | 300 | 200 | 500 | 500 | 400 | — | — | — |
| $CH_4$ [ml/min(normal)] | 25 | 63 | 88 | 120 | 120 | 120 | 130 | 125 | 130 |
| Substrate temp.: (° C.) | 240 | 240 | 240 | 240 | 240 | 240 | 240 | 240 | 240 |
| Reactor internal pressure: (Pa) | 50 | 50 | 50 | 50 | 50 | 50 | 50 | 50 | 50 |
| High-frequency power: (W) | 300 | 300 | 300 | 300 | 300 | 300 | 300 | 300 | 300 |
| C/(Si + C): | 0.04 | 0.10 | 0.15 | 0.20 | 0.22 | 0.29 | 0.31 | 0.35 | 0.41 |

TABLE 15-continued

| | | | | | | | | | |
|---|---|---|---|---|---|---|---|---|---|
| Rate of increase (%) defined by expression (1): | — | 150 | 50 | 33 | 10 | 32 | 7 | 13 | 17 |
| Layer thickness: (nm) | 20 | 30 | 30 | 20 | 20 | 30 | 30 | 30 | 20 |
| Total layer thickness (nm) of C/(Si + C) ≦ 0.35 intermediate layers: | | | | 210 | | | | | — |

| Gases & | Change layer Intermediate layers: | | | | | | Surface |
|---|---|---|---|---|---|---|---|
| Gas flow rates: | 10th | 11th | 12th | 13th | 14th | 15th | layer |
| $SiH_4$ [ml/min(normal)] | 15 | 15 | 12 | 10 | 10 | 10 | 13 |
| $B_2H_6$ (ppm) (based on $SiH_4$) | — | — | — | — | — | — | — |
| $CH_4$ [ml/min(normal)] | 140 | 150 | 180 | 210 | 240 | 300 | 600 |
| Substrate temp.: (° C.) | 240 | 240 | 240 | 240 | 240 | 240 | 240 |
| Reactor internal pressure: (Pa) | 50 | 50 | 50 | 50 | 50 | 50 | 60 |
| High-frequency power: (W) | 300 | 300 | 300 | 300 | 300 | 300 | 400 |
| C/(Si + C): | 0.43 | 0.49 | 0.55 | 0.59 | 0.63 | 0.68 | 0.72 |
| Rate of increase (%) defined by expression (1): | 5 | 14 | 12 | 7 | 7 | 8 | — |
| Layer thickness: (nm) | 50 | 10 | 50 | 210 | 100 | 200 | 1,000 |
| Total layer thickness (nm) of C/(Si + C) ≦ 0.35 intermediate layers: | — | — | — | — | — | — | — |

Example 9-1

A negative-charging electrophotographic photosensitive member was produced in the same way as in Example 8-1 except that, in the procedure of Example 8-1, the intermediate layers were formed under conditions changed as shown in Table 16.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

TABLE 16

| Gases & | Change layer Intermediate layers: | | | | | | | | | Surface |
|---|---|---|---|---|---|---|---|---|---|---|
| Gas flow rates: | 1st | 2nd | 3rd | 4th | 5th | 6th | 7th | 8th | 9th | layer |
| $SiH_4$ [ml/min(normal)] | 75 | 63 | 38 | 22 | 20 | 18 | 15 | 10 | 10 | 13 |
| $B_2H_6$ (ppm) (based on $SiH_4$) | — | 100 | 200 | 100 | — | — | — | — | — | — |
| $CH_4$ [ml/min(normal)] | 25 | 63 | 88 | 125 | 125 | 145 | 188 | 225 | 300 | 600 |
| Substrate temp.: (° C.) | 240 | 240 | 240 | 240 | 240 | 240 | 240 | 240 | 240 | 240 |
| Reactor internal pressure: (Pa) | 50 | 50 | 50 | 50 | 50 | 50 | 50 | 50 | 50 | 60 |
| High-frequency power: (W) | 300 | 300 | 300 | 300 | 300 | 300 | 300 | 300 | 300 | 400 |
| C/(Si + C): | 0.04 | 0.10 | 0.15 | 0.35 | 0.37 | 0.44 | 0.52 | 0.60 | 0.68 | 0.72 |
| Rate of increase (%) defined by expression (1): | — | 150 | 50 | 133 | 6 | 19 | 18 | 15 | 13 | — |
| Layer thickness: (nm) | 80 | 60 | 50 | 20 | 40 | 8 | 20 | 190 | 200 | 1,000 |
| Total layer thickness (nm) of C/(Si + C) ≦ 0.35 intermediate layers: | | | 210 | | — | — | — | — | — | — |

Example 9-2

A negative-charging electrophotographic photosensitive member was produced in the same way as in Example 8-1 except that, in the procedure of Example 8-1, the intermediate layers were formed under conditions changed as shown in Table 17.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

TABLE 17

| Gases & | Change layer Intermediate layers: | | | | | | | | | Surface |
|---|---|---|---|---|---|---|---|---|---|---|
| Gas flow rates: | 1st | 2nd | 3rd | 4th | 5th | 6th | 7th | 8th | 9th | layer |
| $SiH_4$ [ml/min(normal)] | 75 | 63 | 38 | 22 | 20 | 18 | 15 | 10 | 10 | 13 |
| $B_2H_6$ (ppm) (based on $SiH_4$) | — | 200 | 200 | 200 | — | — | — | — | — | — |
| $CH_4$ [ml/min(normal)] | 25 | 63 | 88 | 125 | 125 | 145 | 188 | 225 | 300 | 600 |
| Substrate temp.: (° C.) | 240 | 240 | 240 | 240 | 240 | 240 | 240 | 240 | 240 | 240 |
| Reactor internal pressure: (Pa) | 50 | 50 | 50 | 50 | 50 | 50 | 50 | 50 | 50 | 60 |
| High-frequency power: (W) | 300 | 300 | 300 | 300 | 300 | 300 | 300 | 300 | 300 | 400 |
| C/(Si + C): | 0.04 | 0.10 | 0.15 | 0.35 | 0.37 | 0.44 | 0.52 | 0.60 | 0.68 | 0.72 |
| Rate of increase (%) defined by expression (1): | — | 150 | 50 | 133 | 6 | 19 | 18 | 15 | 13 | — |
| Layer thickness: (nm) | 80 | 40 | 50 | 40 | 40 | 10 | 20 | 190 | 200 | 1,000 |
| Total layer thickness (nm) of C/(Si + C) ≦ 0.35 intermediate layers: | | | 210 | | — | — | — | — | — | — |

Example 10-1

A negative-charging electrophotographic photosensitive member was produced in the same way as in Example 9-1 except that, in the procedure of Example 9-1, the surface layer and the intermediate layers were formed under conditions changed as shown in Table 18.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

TABLE 18

| Gases & | Change layer Intermediate layers: | | | | | | | | | Surface |
|---|---|---|---|---|---|---|---|---|---|---|
| Gas flow rates: | 1st | 2nd | 3rd | 4th | 5th | 6th | 7th | 8th | 9th | layer |
| $SiH_4$ [ml/min(normal)] | 75 | 63 | 38 | 22 | 20 | 15 | 15 | 12 | 10 | 15 |
| $B_2H_6$ (ppm) (based on $SiH_4$) | — | 200 | 200 | 200 | — | — | — | — | — | — |
| $CH_4$ [ml/min(normal)] | 25 | 63 | 88 | 125 | 125 | 140 | 150 | 180 | 200 | 450 |
| Substrate temp.: (° C.) | 240 | 240 | 240 | 240 | 240 | 240 | 240 | 240 | 240 | 240 |
| Reactor internal pressure: (Pa) | 50 | 50 | 50 | 50 | 50 | 50 | 50 | 50 | 50 | 60 |
| High-frequency power: (W) | 300 | 300 | 300 | 300 | 300 | 300 | 300 | 300 | 300 | 400 |
| C/(Si + C): | 0.04 | 0.10 | 0.15 | 0.35 | 0.37 | 0.43 | 0.49 | 0.55 | 0.58 | 0.61 |

TABLE 18-continued

| Gases & Gas flow rates: | Change layer Intermediate layers: 1st | 2nd | 3rd | 4th | 5th | 6th | 7th | 8th | 9th | Surface layer |
|---|---|---|---|---|---|---|---|---|---|---|
| Rate of increase (%) defined by expression (1): | — | 150 | 50 | 133 | 6 | 16 | 14 | 12 | 5 | — |
| Layer thickness: (nm) | 80 | 40 | 40 | 40 | 40 | 10 | 40 | 190 | 200 | 1,000 |
| Total layer thickness (nm) of C/(Si + C) ≦ 0.35 intermediate layers: | 200 | | | | — | — | — | — | — | — |

Example 10-2

A negative-charging electrophotographic photosensitive member was produced in the same way as in Example 9-1 except that, in the procedure of Example 9-1, the surface layer and the intermediate layers were formed under conditions changed as shown in Table 19.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

TABLE 19

| Gases & Gas flow rates: | Change layer Intermediate layers: 1st | 2nd | 3rd | 4th | 5th | 6th | 7th | 8th | 9th | Surface layer |
|---|---|---|---|---|---|---|---|---|---|---|
| $SiH_4$ [ml/min(normal)] | 75 | 63 | 38 | 22 | 20 | 18 | 15 | 10 | 10 | 13 |
| $B_2H_6$ (ppm) (based on $SiH_4$) | — | 200 | 200 | 200 | — | — | — | — | — | — |
| $CH_4$ [ml/min(normal)] | 25 | 63 | 88 | 125 | 125 | 145 | 188 | 225 | 300 | 600 |
| Substrate temp.: (° C.) | 240 | 240 | 240 | 240 | 240 | 240 | 240 | 240 | 240 | 240 |
| Reactor internal pressure: (Pa) | 50 | 50 | 50 | 50 | 50 | 50 | 50 | 50 | 50 | 60 |
| High-frequency power: (W) | 300 | 300 | 300 | 300 | 300 | 300 | 300 | 300 | 300 | 400 |
| C/(Si + C): | 0.04 | 0.10 | 0.15 | 0.35 | 0.37 | 0.44 | 0.52 | 0.60 | 0.68 | 0.72 |
| Rate of increase (%) defined by expression (1): | — | 150 | 50 | 133 | 6 | 19 | 18 | 15 | 13 | — |
| Layer thickness: (nm) | 80 | 40 | 40 | 40 | 40 | 10 | 40 | 190 | 200 | 1,000 |
| Total layer thickness (nm) of C/(Si + C) ≦ 0.35 intermediate layers: | 200 | | | | — | — | — | — | — | — |

Example 11

A negative-charging electrophotographic photosensitive member was produced in the same way as in Example 10-1 except that, in the procedure of Example 10-1, the lower-part charge injection blocking layer was formed in two layers under conditions changed as shown in Table 20.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

TABLE 20

| Gases & Gas flow rates: | First lower-part charge injection blocking layer | Second lower-part charge injection blocking layer |
|---|---|---|
| $SiH_4$ [ml/min(normal)] | 100 | 100 |
| $H_2$ [ml/min(normal)] | 500 | 650 |

TABLE 20-continued

| Gases & Gas flow rates: | First lower-part charge injection blocking layer | Second lower-part charge injection blocking layer |
|---|---|---|
| $B_2H_6$ (ppm) (based on $SiH_4$) | 1,000 | — |
| NO (%) (based on $SiH_4$) | 10 | 50 |

TABLE 20-continued

| Gases & Gas flow rates: | First lower-part charge injection blocking layer | Second lower-part charge injection blocking layer |
|---|---|---|
| $CH_4$ [ml/min(normal)] | — | 100 |
| Substrate temp.: (° C.) | 270 | 260 |
| Reactor internal pressure: (Pa) | 80 | 80 |
| High-frequency power: (W) | 100 | 120 |
| Layer thickness: (nm) | 1,200 | 1,000 |

Example 12-1

A negative-charging electrophotographic photosensitive member was produced in the same way as in Example 6 except that, in the procedure of Example 6, the intermediate layers were formed under conditions changed as shown in Table 21.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

TABLE 21

| Gases & | Change layer Intermediate layers: | | | | |
|---|---|---|---|---|---|
| Gas flow rates: | 1st | 2nd | 3rd | 4th | 5th |
| $SiH_4$ [ml/min(normal)] | 75 | 55 | 20 | 17 | 12 |
| $B_2H_6$ (ppm) (based on $SiH_4$) | 25 | 45 | 120 | 150 | 200 |
| $CH_4$ [ml/min(normal)] | — | 150 | 150 | 150 | — |
| Substrate temp.: (° C.) | 240 | 240 | 240 | 240 | 240 |
| Reactor internal pressure: (Pa) | 50 | 50 | 50 | 50 | 50 |
| High-frequency power: (W) | 300 | 300 | 300 | 300 | 300 |
| C/(Si + C): | 0.04 | 0.10 | 0.34 | 0.47 | 0.56 |
| Rate of increase (%) defined by expression (1): | — | 150 | 240 | 38 | 19 | — |
| Layer thickness: (nm) | 80 | 10 | 10 | 10 | 210 |
| Total layer thickness (nm) of C/(Si + C) ≦ 0.35 intermediate layers: | | 100 | | — | — |
| Total layer thickness (nm) of intermediate layers incorporated with Group 13 element: | — | | 30 | | — |

Example 12-2

A negative-charging electrophotographic photosensitive member was produced in the same way as in Example 6 except that, in the procedure of Example 6, the intermediate layers were formed under conditions changed as shown in Table 22.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

TABLE 22

| Gases & | Change layer Intermediate layers: | | | | |
|---|---|---|---|---|---|
| Gas flow rates: | 1st | 2nd | 3rd | 4th | 5th |
| $SiH_4$ [ml/min(normal)] | 75 | 55 | 20 | 17 | 12 |
| $B_2H_6$ (ppm) (based on $SiH_4$) | — | 150 | 150 | 150 | — |
| $CH_4$ [ml/min(normal)] | 25 | 45 | 120 | 150 | 200 |
| Substrate temp.: (° C.) | 240 | 240 | 240 | 240 | 240 |
| Reactor internal pressure: (Pa) | 50 | 50 | 50 | 50 | 50 |
| High-frequency power: (W) | 300 | 300 | 300 | 300 | 300 |
| C/(Si + C): | 0.04 | 0.10 | 0.34 | 0.47 | 0.56 |
| Rate of increase (%) defined by expression (1): | — | 150 | 240 | 38 | 19 | — |
| Layer thickness: (nm) | 80 | 20 | 20 | 10 | 210 |
| Total layer thickness (nm) of C/(Si + C) ≦ 0.35 intermediate layers: | | 120 | | — | — |
| Total layer thickness (nm) of intermediate layers incorporated with Group 13 element: | — | | 50 | | — |

Example 12-3

A negative-charging electrophotographic photosensitive member was produced in the same way as in Example 6 except that, in the procedure of Example 6, the intermediate layers were formed under conditions changed as shown in Table 23.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

TABLE 23

| Gases & | Change layer Intermediate layers: | | | | |
|---|---|---|---|---|---|
| Gas flow rates: | 1st | 2nd | 3rd | 4th | 5th |
| $SiH_4$ [ml/min(normal)] | 75 | 55 | 20 | 17 | 12 |
| $B_2H_6$ (ppm) (based on $SiH_4$) | — | 150 | 150 | 150 | 150 |
| $CH_4$ [ml/min(normal)] | 25 | 45 | 120 | 150 | 200 |
| Substrate temp.: (° C.) | 240 | 240 | 240 | 240 | 240 |

TABLE 23-continued

| Gases & Gas flow rates: | Change layer Intermediate layers: 1st | 2nd | 3rd | 4th | 5th |
|---|---|---|---|---|---|
| Reactor internal pressure: (Pa) | 50 | 50 | 50 | 50 | 50 |
| High-frequency power: (W) | 300 | 300 | 300 | 300 | 300 |
| C/(Si + C): | 0.04 | 0.10 | 0.34 | 0.47 | 0.56 |
| Rate of increase (%) defined by expression (1): | — | 150 | 240 | 38 | 19 | — |
| Layer thickness: (nm) | 80 | 150 | 150 | 400 | 300 |
| Total layer thickness (nm) of C/(Si + C) ≦ 0.35 intermediate layers: | | 380 | | — | — |
| Total layer thickness (nm) of intermediate layers incorporated with Group 13 element: | — | | 1,000 | | |

TABLE 24

| Gases & Gas flow rates: | Change layer Intermediate layers: 1st | 2nd | 3rd | 4th | 5th |
|---|---|---|---|---|---|
| $SiH_4$ [ml/min(normal)] | 75 | 55 | 20 | 17 | 12 |
| $B_2H_6$ (ppm) (based on $SiH_4$) | — | 150 | 150 | 150 | 150 |
| $CH_4$ [ml/min(normal)] | 25 | 45 | 120 | 150 | 200 |
| Substrate temp.: (° C.) | 240 | 240 | 240 | 240 | 240 |
| Reactor internal pressure: (Pa) | 50 | 50 | 50 | 50 | 50 |
| High-frequency power: (W) | 300 | 300 | 300 | 300 | 300 |
| C/(Si + C): | 0.04 | 0.10 | 0.34 | 0.47 | 0.56 |
| Rate of increase (%) defined by expression (1): | — | 150 | 240 | 38 | 19 | — |
| Layer thickness: (nm) | 80 | 150 | 150 | 400 | 400 |
| Total layer thickness (nm) of C/(Si + C) ≦ 0.35 intermediate layers: | | 380 | | — | — |
| Total layer thickness (nm) of intermediate layers incorporated with Group 13 element: | — | | 1,100 | | |

Example 12-4

A negative-charging electrophotographic photosensitive member was produced in the same way as in Example 6 except that, in the procedure of Example 6, the intermediate layers were formed under conditions changed as shown in Table 24.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

Comparative Example 3

A negative-charging electrophotographic photosensitive member was produced in the same way as in Example 6 except that, in the procedure of Example 6, the surface layer and the intermediate layers were formed under conditions changed as shown in Table 25.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

TABLE 25

| Gases & Gas flow rates: | Change layer Intermediate layers: 1st | 2nd | 3rd | 4th | 5th | Surface layer |
|---|---|---|---|---|---|---|
| $SiH_4$ [ml/min(normal)] | 75 | 55 | 20 | 15 | 12 | 15 |
| $B_2H_6$ (ppm) (based on $SiH_4$) | — | 150 | 150 | 150 | — | — |
| $CH_4$ [ml/min(normal)] | 25 | 45 | 120 | 140 | 170 | 450 |
| Substrate temp.: (° C.) | 240 | 240 | 240 | 240 | 240 | 240 |
| Reactor internal pressure: (Pa) | 50 | 50 | 50 | 50 | 50 | 60 |
| High-frequency power: (W) | 300 | 300 | 300 | 300 | 300 | 400 |
| C/(Si + C): | 0.04 | 0.10 | 0.34 | 0.43 | 0.54 | 0.61 |

TABLE 25-continued

| Gases & Gas flow rates: | Change layer Intermediate layers: 1st | 2nd | 3rd | 4th | 5th | Surface layer |
|---|---|---|---|---|---|---|
| Rate of increase (%) defined by expression (1): | — | 150 | 240 | 26 | 26 | — |
| Layer thickness: (nm) | 80 | 60 | 70 | 80 | 210 | 1,000 |
| Total layer thickness (nm) of C/(Si + C) ≦ 0.35 intermediate layers: | | 210 | | — | — | — |

Comparative Example 4

A negative-charging electrophotographic photosensitive member was produced in the same way as in Example 6 except that, in the procedure of Example 6, the surface layer and the intermediate layers were formed under conditions changed as shown in Table 26.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

TABLE 26

| Gases & Gas flow rates: | Change layer Intermediate layers: 1st | 2nd | 3rd | 4th | 5th | Surface layer |
|---|---|---|---|---|---|---|
| $SiH_4$ [ml/min(normal)] | 75 | 55 | 20 | 17 | 12 | 10 |
| $B_2H_6$ (ppm) (based on $SiH_4$) | — | 150 | 150 | 150 | — | — |
| $CH_4$ [ml/min(normal)] | 25 | 45 | 120 | 150 | 200 | 200 |
| Substrate temp.: (° C.) | 240 | 240 | 240 | 240 | 240 | 240 |
| Reactor internal pressure: (Pa) | 50 | 50 | 50 | 50 | 50 | 60 |
| High-frequency power: (W) | 300 | 300 | 300 | 300 | 300 | 400 |
| C/(Si + C): | 0.04 | 0.10 | 0.34 | 0.47 | 0.56 | 0.58 |
| Rate of increase (%) defined by expression (1): | — | 150 | 240 | 38 | 19 | — |
| Layer thickness: (nm) | 80 | 60 | 70 | 80 | 210 | 1,000 |
| Total layer thickness (nm) of C/(Si + C) ≦ 0.35 intermediate layers: | | 210 | | — | — | — |

Comparative Example 5

A negative-charging electrophotographic photosensitive member was produced in the same way as in Example 6 except that, in the procedure of Example 6, the surface layer and the intermediate layers were formed under conditions changed as shown in Table 27.

The C/(Si+C) and layer thickness of each of the intermediate layers and surface layer of the negative-charging electrophotographic photosensitive member thus produced were measured and calculated in the same way as in Example 1. The electrophotographic photosensitive member thus produced was also evaluated in the same way as in Example 6. Results obtained are shown in Table 28.

TABLE 27

| Gases & Gas flow rates: | Change layer Intermediate layers: 1st | 2nd | 3rd | 4th | 5th | Surface layer |
|---|---|---|---|---|---|---|
| $SiH_4$ [ml/min(normal)] | 75 | 55 | 20 | 17 | 12 | 15 |
| $B_2H_6$ (ppm) (based on $SiH_4$) | 150 | 150 | 150 | — | — | — |
| $CH_4$ [ml/min(normal)] | 25 | 45 | 120 | 150 | 200 | 450 |
| Substrate temp.: (° C.) | 240 | 240 | 240 | 240 | 240 | 240 |
| Reactor internal pressure: (Pa) | 50 | 50 | 50 | 50 | 50 | 60 |
| High-frequency power: (W) | 300 | 300 | 300 | 300 | 300 | 400 |
| C/(Si + C) | 0.04 | 0.10 | 0.34 | 0.47 | 0.56 | 0.61 |
| Rate of increase (%) defined by expression (1): | — | 150 | 240 | 38 | 19 | — |
| Layer thickness: (nm) | 80 | 60 | 70 | 80 | 210 | 1,000 |
| Total layer thickness (nm) of C/(Si + C) ≦ 0.35 intermediate layers: | | 210 | | — | — | — |

TABLE 28

| | Delamination resistance 1 | Delamination resistance 2 | Blr. images | Surface layer wear level | Sensitivity | Potential non-uniformity | Charge-ability | Overall evaluation |
|---|---|---|---|---|---|---|---|---|
| Example: | | | | | | | | |
| 6 | A | A | AA | A | AA | AA | AA | A |
| 7 | A | A | AA | AA | AA | AA | AA | A |
| 8-1 | A | A | AA | AA | AA | AA | AA | A |
| 8-2 | A | A | AA | AA | A | AA | AA | A |
| 9-1 | A | AA | AA | AA | AA | A | AA | A |
| 9-2 | A | AA | AA | AA | AA | AA | AA | AA |
| 10-1 | A | AA | AA | A | AAA | AA | AA | AA |
| 10-2 | A | AA | AA | AA | AAA | AA | AA | AA |
| 11 | A | AA | AA | A | AAA | AA | AA | AA |
| 12-1 | A | A | AA | A | AAA | AA | A | A |
| 12-2 | A | A | AA | A | AAA | AA | AA | A |
| 12-3 | A | A | AA | A | AA | AA | AA | A |
| 12-4 | A | A | A | A | AA | AA | AA | A |
| Comparative Example: | | | | | | | | |
| 3 | B | B | AA | A | AA | AA | AA | B |
| 4 | A | A | AA | B | AA | AA | AA | B |
| 5 | A | A | B | A | AA | AA | AA | B |

Blr.: Blurred

How the present invention is effective is explained below on the basis of the results shown in Table 28.

It is seen from Example 6 and Comparative Example 3 that both the delamination resistance 1 and the delamination resistance 2 can be good and the a-SiC intermediate layers can not easily come to separate between their layers (cause delamination) when, where, among the intermediate layers included in the change layer, two layers contiguous to each other are selected from among intermediate layers in which the C/(Si+C) is in the range of from 0.35 or more to 0.65 or less, and, between the two layers contiguous to each other, the C/(Si+C) in an intermediate layer on the photoconductive layer side is represented by A and the C/(Si+C) in an intermediate layer on the surface layer side is represented by B, the rate of increase between layers as defined by the expression (1) is 19% or less.

It is also seen from Example 6 and Comparative Example 4 that the surface layer wear level can be small and the electrophotographic photosensitive member can be improved in its wear resistance when the C/(Si+C) in the surface layer is from 0.61 or more to 0.90 or less.

It is still also seen from Example 6 and Example 7 that the surface layer wear level can especially be smaller and the electrophotographic photosensitive member can be more improved in its wear resistance when the C/(Si+C) in the surface layer is from 0.70 or more to 0.90 or less.

It is still also seen from Example 6 and Comparative Example 5 that the blurred images can not easily occur when the C/(Si+C) of the a-SiC intermediate layers incorporated with Group 13 element is 0.10 or more.

It is still also seen from Example 8-1 and Example 8-2 that the electrophotographic photosensitive member can be kept from lowering in sensitivity when the number of layers of the a-SiC intermediate layers included in the change layer is nine layers or less. Thus, it is seen that the number of layers of the a-SiC intermediate layers included in the change layer may preferably be five layers or more to nine layers or less.

It is still also seen from Example 8-1 and Example 9-2 that the a-SiC intermediate layers can more not easily come to separate between their layers when the a-SiC intermediate layers included in the change layer each have a layer thickness of 200 nm or less. It is also seen from Example 9-1 and Example 9-2 that the potential non-uniformity can be remedied when the a-SiC intermediate layers included in the change layer each have a layer thickness of 10 nm or more. Thus, it is seen that the a-SiC intermediate layers included in the change layer may each preferably have a layer thickness of from 10 nm or more to 200 nm or less.

It is still also seen from Example 9-2 and Example 10-2 that the electrophotographic photosensitive member can be kept from lowering in sensitivity when any a-SiC intermediate layers in which the C/(Si+C) is 0.35 or less have a layer thickness of 200 nm or less in total.

It is still also seen from Example 12-1 and Example 12-2 that the electrophotographic photosensitive member can be improved in charge characteristics, in particular, negative-charge injection blocking ability under conditions of a high electric field when the a-SiC intermediate layers incorporated with Group 13 element have a layer thickness of 50 nm or more in total. It is still also seen from Example 12-3 and Example 12-4 that the blurred images can not easily occur when the a-SiC intermediate layers incorporated with Group 13 element have a layer thickness of 1,000 nm or less in total. Thus, it is seen that the a-SiC intermediate layers incorporated with Group 13 element may preferably have a layer thickness of from 50 nm or more to 1,000 nm or less in total.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-101836, filed Apr. 20, 2009, Japanese Patent Application No. 2009-116021, filed May 12, 2009, and Japanese Patent Application No. 2010-088797, filed Apr. 7, 2010, which are hereby incorporated by reference herein in their entirety.

The invention claimed is:

1. An electrophotographic photosensitive member comprising:

a substrate, a photoconductive layer comprising amorphous silicon, a change layer, and a surface layer, in this order, wherein, the surface layer comprises hydrogenated amorphous silicon carbide, and has a ratio of a number of carbon atoms to the sum of a number silicon atoms and the number of carbon atoms, C/(Si+C), of from 0.61 to 0.90, the change layer includes five or more intermediate layers containing hydrogenated amorphous silicon carbide, and having respective ratios of C(Si+C), the respective ratios C/(Si+C) of the intermediate layers are smaller than the ratio of C/(Si+C) of the surface layer, and increase monotonously from an innermost intermediate layer on the side of the photoconductive layer toward an outermost intermediate layer on the side of the surface layer, wherein, among the intermediate layers, at least two intermediate layers which are contiguous to each other, one of which on the side of the photoconductive layer is defined as a first intermediate layer, and the other on the side of the surface layer is defined as a second intermediate layer, have C/(Si+C) of from 0.35 to 0.65 and wherein, when C/(Si+C) of the first intermediate layer is defined as A, and C/(Si+C) of the second intermediate layer is defined as B, A and B satisfy the following inequality (1):

$$\{(B-A)/A\}\times 100 \leqq 19\% \quad (1).$$

2. The electrophotographic photosensitive member according to claim 1, wherein the ratio of the number of carbon atoms (C) to the sum of the number of silicon atoms (Si) and the number of carbon atoms (C), C/(Si+C), in the surface layer is from 0.70 or more to 0.90 or less.

3. The electrophotographic photosensitive member according to claim 1, wherein the change layer is a layer consisting essentially of five or more to nine or less intermediate layers.

4. The electrophotographic photosensitive member according to claim 1, wherein the intermediate layers included in the change layer each have a layer thickness of from 10 nm or more to 200 nm or less.

5. The electrophotographic photosensitive member according to claim 1, wherein, among the intermediate layers included in the change layer, intermediate layers in which the ratio of the number of carbon atoms (C) to the sum of the number of silicon atoms (Si) and the number of carbon atoms (C), C/(Si+C), is 0.35 or less have a layer thickness of 200 nm or less in total.

6. The electrophotographic photosensitive member according to claim 1, wherein at least one intermediate layer incorporated with Group 13 element is included in the change layer.

7. The electrophotographic photosensitive member according to claim 6, wherein the ratio of the number of carbon atoms (C) to the sum of the number of silicon atoms (Si) and the number of carbon atoms (C), C/(Si+C), in the intermediate layer(s) incorporated with Group 13 element is 0.10 or more.

8. The electrophotographic photosensitive member according to claim 6, wherein, among the intermediate layers included in the change layer, the intermediate layers incorporated with Group 13 element have a layer thickness of from 50 nm or more to 1,000 nm or less in total.

9. An electrophotographic apparatus comprising the electrophotographic photosensitive member according to claim 1, and further comprising:

a charging assembly to electrostatically charge the electrophotographic photosensitive member, an imagewise exposure unit to form an electrostatic latent image on the electrophotographic photosensitive member, a developing assembly to form toner images on the electrophotographic photosensitive member, a transfer unit receiving the toner images, and a cleaner to clean a surface of the electrophotographic photosensitive member.

* * * * *